US005678366A

United States Patent [19]

Nambo et al.

[11] Patent Number: 5,678,366

[45] Date of Patent: Oct. 21, 1997

[54] SLIDING WINDOW STRUCTURE

[75] Inventors: Hiroki Nambo, Toyama-ken; Shigeru Ueda, Chiba-ken; Toshiaki Hirono; Yuichi Nozaki, both of Toyama-ken, all of Japan

[73] Assignee: YKK Architectural Products Inc., Tokyo, Japan

[21] Appl. No.: 561,381

[22] Filed: Nov. 21, 1995

[30] Foreign Application Priority Data

Nov. 30, 1994 [JP] Japan ..... 6-297388
May 2, 1995 [JP] Japan ..... 7-143862

[51] Int. Cl.[6] ..... F06B 1/12; F06B 1/70

[52] U.S. Cl. ..... 52/207; 52/204.51; 52/213; 49/467; 49/468; 49/471

[58] Field of Search ..... 52/204.51, 207, 52/213; 49/467, 468, 471

[56] References Cited

U.S. PATENT DOCUMENTS

| | | | |
|---|---|---|---|
| 2,847,726 | 8/1958 | Frick | 52/207 |
| 4,098,027 | 7/1978 | Crance | 49/468 X |
| 4,151,682 | 5/1979 | Schmidt . | |
| 4,219,971 | 9/1980 | Mauroner . | |
| 4,229,905 | 10/1990 | Rush . | |
| 4,656,782 | 4/1987 | Guelck . | |
| 4,674,246 | 6/1987 | Giguere | 52/204.51 |
| 4,922,661 | 5/1990 | Dallaire et al. | 49/504 |
| 5,123,212 | 6/1992 | Dallaire et al. | 49/471 X |
| 5,379,824 | 1/1995 | Carvalho . | |

FOREIGN PATENT DOCUMENTS

| | | |
|---|---|---|
| 0 495 727 A1 | 1/1992 | European Pat. Off. . |
| 61-206081 | 12/1986 | Japan . |
| 3-66384 | 6/1991 | Japan . |
| 1 515 676 | 6/1978 | United Kingdom . |
| 2 158 496 | 11/1985 | United Kingdom . |

*Primary Examiner*—Wynn E. Wood
*Assistant Examiner*—Timothy B. Kang
*Attorney, Agent, or Firm*—Finnegan, Henderson, Farabow, Garrett & Dunner, L.L.P.

[57] ABSTRACT

A sliding window structure has a window frame comprising an upper frame member, a lower frame member and bilateral side vertical frame members which are assembled in substantially rectangular shape, and an indoor side sash and an outdoor side sash fitted to the window frame. The lower frame member comprises an indoor side portion to which the indoor side sash is mounted and the outdoor side portion to which the outdoor side sash is mounted and has a step-like configuration in which the indoor side portion has a height higher than a height of the outdoor side portion. An attachment is mounted to the outdoor side portion of the lower frame member so as to cover the outdoor side portion. An upper end of the attachment is substantially at the same height level as an upper end of the indoor side portion of the lower frame member.

11 Claims, 21 Drawing Sheets

SLIDING WINDOW STRUCTURE

BACKGROUND OF THE INVENTION

1. Field of the Invention

The present invention relates to a sliding window structure provided as an entrance or exit to a veranda, a balcony, a terrace, a garden or the like.

2. Description of the Prior Art

There are known a variety of sliding window structures forming an entrance or exit to a veranda, a balcony, a terrace, a garden or the like. For example, Japanese Unexamined Utility Model Publication No. Sho 61-206081 discloses such one as constituted as an inside single sliding window structure, in which a window frame is composed of an upper frame member, a lower frame member and bilateral side vertical frame members, an indoor side sash is fitted at an indoor side portion of the window frame so as to be movable or slidable in a width direction of the window frame, and an outdoor side sash is fitted at an outdoor side portion of the window frame so as to be fixed on one of the laterally left and right sides of the window frame. Since the window structure is intended to form an entrance or exit to a veranda, a balcony, a terrace, a garden or the like, and therefore has a function as a boundary between the indoor space and the outdoor space, the lower frame member is formed in step-like configuration in which the indoor side portion thereof has a height higher than a height of the outdoor side portion, thereby preventing rain water from blowing or invading into an inside room along the lower frame member.

However, the step-like configuration of the lower frame member is inconvenient for an aged person to go in or out through the window. Further, in the case of a person on a wheelchair, a helper's hand is necessary to pass over the step-like lower frame member.

In order to obviate these problems, Japanese Unexamined Utility Model Publication No. Hei 3-66384 discloses a sliding window structure in which three rails having substantially the same height as each other and respectively having the same shapes as those of the rails originally provided on an existing lower frame member are formed on an upper surface of an attachment, and thus formed attachment is mounted so as to cover the rails of the existing lower frame member, thereby realizing an entrance portion having no step.

However, in the above structure, since the attachment is provided to cover an entire surface of the existing lower frame member, material corresponding to the entire width and the entire length of the lower frame member is required, which makes the window structure expensive.

SUMMARY OF THE INVENTION

A primary object of the present invention is to substantially eliminate defects or drawbacks encountered in the prior art and to provide a sliding window structure having a flat entrance portion at a lower cost.

A further object of the present invention is to provide a preferred inside single sliding window structure which meets the above mentioned primary object.

A furthermore object of the present invention is to provide various types of sliding window structures which are formed by utilizing existing window structures so as to meet the above mentioned primary object.

According to the present invention, the primary object can be achieved by a sliding window structure having a window frame comprising an upper frame member, a lower frame member and bilateral side vertical frame members which are assembled in substantially rectangular shape, and an indoor side sash and an outdoor side sash fitted to the window frame, the lower frame member comprising an indoor side portion to which the indoor side sash is mounted and an outdoor side portion to which the outdoor side sash is mounted and having a step-like configuration in which the indoor side portion has a height higher than a height of the outdoor side portion, wherein an attachment is mounted to the outdoor side portion of the lower frame member so as to cover the outdoor side portion, an upper end of the attachment being substantially at the same height level as an upper end of the indoor side portion of the lower frame member.

According to this aspect of the present invention, since the upper end of the attachment mounted to the outdoor side portion of the lower frame member is substantially at the same height level as the upper end of the indoor side portion of the lower frame member, thereby providing a substantially flat surface on the lower frame member, a person can easily go in and out through this flatted portion of the window, and even by a wheelchair, also can go in and out easily and smoothly. Further, since the step-like configuration of the lower frame member proper is left as it is, rain water is prevented from blowing or invading into an inside room along the lower frame member. Furthermore, since the attachment is so provided as to cover only the outdoor side portion of the lower frame member and therefore has a smaller size, material required for the attachment is reduced, which contributes to lowering of cost.

As a preferred embodiment constituted as an inside single window structure, the present invention provides a structure in which the indoor side sash is mounted on a rail integrally formed at the indoor side portion of the lower frame member so as to be slidable in a width direction of the window frame and the outdoor side sash is mounted and fixed to the outdoor side portion of the lower frame member on one of the laterally left and right sides of the window frame, wherein the attachment is provided with an upper flat surface and is mounted to the outdoor side portion of the lower frame member on the lateral one side opposite to that occupied by the outdoor side sash, the upper flat surface of the attachment being substantially at the same height level as an upper end of the rail of the lower frame member, and an upwardly opening recessed portion being defined between the attachment and the indoor side portion of the lower frame member, through which the indoor side sash is slidable.

Preferably, the attachment is a long-shaped member having an inner hollow portion defined by an upper transverse plate, a lower transverse plate, an indoor side vertical plate and an outdoor side vertical plate, an upper surface of the upper transverse plate is substantially at the same height level as an upper end of the rail of the lower frame member, and the indoor side vertical plate forms an outdoor side wall and a bottom of the upwardly opening recessed portion. Drain ports are formed to the outdoor side wall of the upwardly opening recessed portion, the lower transverse plate and the outdoor side vertical plate so that rain water invading in the upwardly opening recessed portion is drained outward through the drain ports.

Alternatively, the attachment may be provided with a support piece and an attachment piece each projecting downwardly from the lower transverse plate, with which the attachment is mounted on the outdoor side portion of the lower frame member. Drain ports are formed to the bottom of the upwardly opening recessed portion, the support piece and the attachment piece so that rain water invading in the upwardly opening recessed portion is drained outward without passing though the inner hollow portion of the attachment.

Alternatively, the attachment may be a long-shaped member having an upper transverse plate, an indoor side vertical plate and an outdoor side vertical plate, and defining an inner hollow portion in cooperation with an upper surface of the lower frame member.

Further, within the conception of the present invention, various types of sliding window structures are provided by utilizing existing sliding window structures.

First, a double sliding window structure is provided by utilizing an existing inside single sliding window structure, wherein a lower frame member is a lower frame member of an existing inside single sliding window structure in which a rail is integrally formed at an indoor side portion and a frame element for mounting and fixing a sash therein is attached at an outdoor side portion, an attachment formed with a rail having substantially the same configuration as that of the rail of the lower frame member is mounted to the lower frame member so as to cover the outdoor side portion thereof from which the frame element is removed, an upper end of the rail of the attachment being substantially at the same height level as an upper end of the rail of the lower frame member, the indoor side sash is mounted on the rail of the lower frame member and the outdoor side sash is mounted on the rail of the attachment.

Second, a double sliding window structure is provided by utilizing an existing double sliding window structure, wherein a lower frame member is a lower frame member of an existing double sliding window structure in which a first rail is integrally formed at an indoor side portion and a second rail is integrally formed at an outdoor side portion, an upper end of the first rail being at a level higher than an upper end of the second rail, an attachment formed with a rail having substantially the same configuration as that of the first rail is mounted on the second rail, an upper end of the rail of the attachment being substantially at the same height level as an upper end of the first rail of the lower frame member, the indoor side sash is mounted on the first rail of the lower frame member and the outdoor side sash is mounted on the rail of the attachment.

Thirdly, an outside single sliding window structure is provided by utilizing an existing outside single sliding window structure, wherein a lower frame member is a lower frame member of an existing outside single sliding window structure in which a mounting groove for mounting and fixing a sash therein is integrally formed at an indoor side portion and a rail is integrally formed at an outdoor side portion, an attachment formed with a rail is mounted on the rail of the lower frame member, an upper end of the rail of the attachment being substantially at the same height level as an upper end of the mounting groove of the lower frame member, the indoor side sash is mounted and fixed in the mounting groove of the lower frame member on one of the laterally left and right sides of the window frame and the outdoor side sash is mounted on the rail of the attachment. Preferably, a cover is further attached to the mounting groove of the lower frame member on the lateral one side opposite to that occupied by the indoor side sash, an upper surface of the cover being substantially at the same height level as an upper end of the rail of the attachment.

Fourthly, an inside single sliding window structure is provided by utilizing an existing inside single sliding window structure, wherein a lower frame member is a lower frame member of an existing inside single sliding window structure having a rail integrally formed at an indoor side portion thereof, a frame element formed with a mounting groove and having a longitudinal length substantially half the longitudinal length of the lower frame member is attached to an outdoor side portion of the lower frame member on one of the laterally left and right sides of the window frame, the indoor side sash is mounted on the rail and the outdoor side sash is mounted and fixed in the mounting groove, and an attachment having an upper flat surface and having a longitudinal length substantially half the longitudinal length of the lower frame member is mounted to the outdoor side portion of the lower frame member on the lateral one side opposite to that occupied by the outdoor side sash, the upper flat surface of the attachment being substantially at the same height level as an upper end of the rail of the lower frame member.

Fifthly, an inside single sliding window structure is provided by utilizing an existing double sliding window structure, wherein a lower frame member is a lower frame member of an existing double sliding window structure in which a first rail is integrally formed at an indoor side portion and a second rail is integrally formed at an outdoor side portion, an upper end of the first rail being at a level higher than an upper end of the second rail, the indoor side sash is mounted on the first rail, the outdoor side sash is mounted on the second rail on one of the laterally left and right sides of the window frame, an attachment having an upper flat surface and having a longitudinal length substantially half the longitudinal length of the lower frame member is mounted on the second rail on the lateral one side of the window frame opposite to that occupied by the outdoor side sash so as to be adjacent to the outdoor side sash and thereby fix the outdoor side sash, the upper flat surface of the attachment being substantially at the same height level as an upper end of the first rail of the lower frame member.

In these various types of sliding window structures formed by utilizing the existing sliding window structures, since the upper end of the attachment mounted to the outdoor side portion of the lower frame member is substantially at the same height level as the upper end of the indoor side portion of the lower frame member, thereby providing a substantially flat surface on the lower frame member, a person can smoothly go in and out through this flatted portion of the window even by a wheelchair. Further, since the step-like configuration of the lower frame member of the existing sliding window structure is left as it is, rain water is prevented from blowing or invading into an inside room along the lower frame member. Furthermore, since the attachment is so provided as to cover only the outdoor side portion of the lower frame member and therefore has a smaller size, material required for the attachment is reduced and a cost is lowered.

The nature and further features of the present invention will be made more clear from the following descriptions made by way of preferred examples shown in the accompanying drawings.

DESCRIPTION OF THE PREFERRED EMBODIMENTS

A first embodiment of the present invention will be described hereunder with reference to FIGS. 1 to 5.

Figure 1:
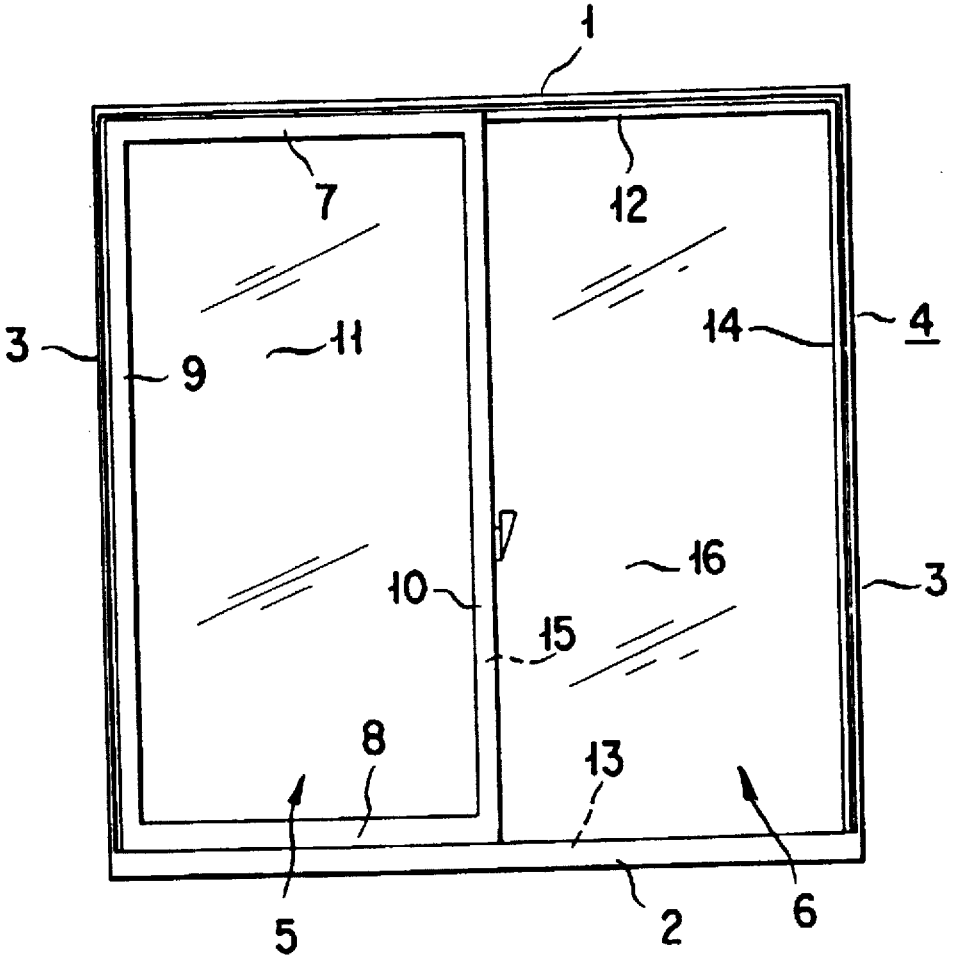
FIG. 1 is a schematic front view of an inside single sliding window structure according to a first embodiment of the present invention.

As shown in FIG. 1, a window frame 4 is composed of an upper frame member 1, a lower frame member 2 and bilateral side vertical frame members 3, 3 which are assembled in a rectangular shape. An indoor side sash 5 is fitted to the indoor side of the window frame 4 so as to be movable or slidable in a width direction of the window frame and an outdoor side sash 6 is fitted to the outdoor side of the window frame 4 so as to be fixed on one of the laterally left and right sides (the right side according to FIG. 1) of the window frame 4, thereby constituting an inside single sliding window structure.

The indoor side sash 5 is composed of an upper frame element 7, a lower frame element 8, an end frame element 9, a mating frame element 10, which are assembled in a rectangular shape, and a glass 11 fitted to thus assembled frame elements. The outdoor side sash 6 is composed of an upper frame element 12, a lower frame element 13, an end frame element 14, a mating frame element 15, which are assembled in a rectangular shape, and a glass 16 fitted to thus assembled frame elements.

Figure 2:
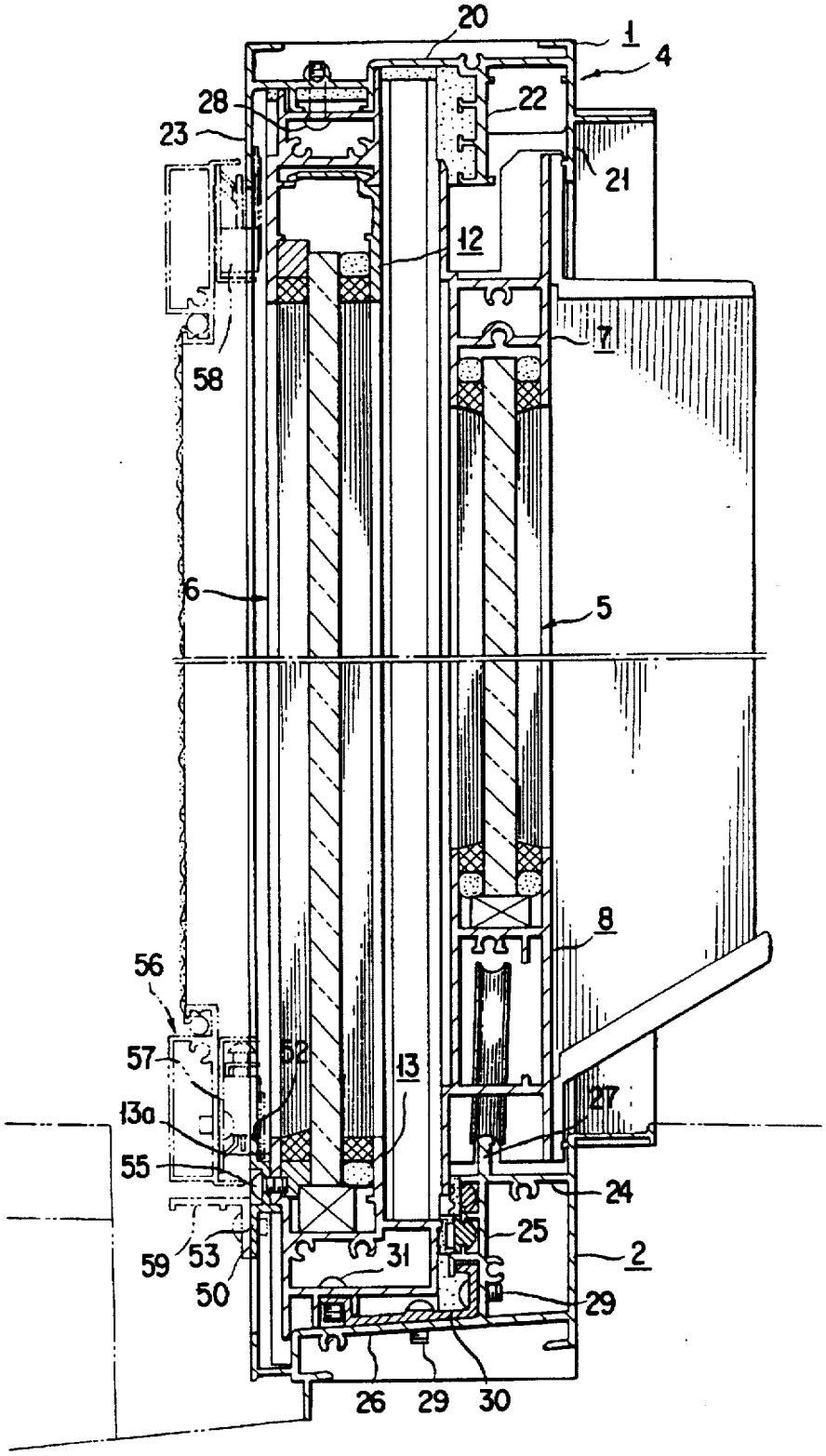
FIG. 2 is a vertical sectional view of the window structure of FIG. 1.

As shown in FIG. 2, the upper frame member 1 of the window frame 4 comprises a transverse plate 20, an indoor side vertical plate 21, an indoor side upper rail 22 and an outdoor side vertical plate 23. The lower frame member 2 comprises an indoor side transverse plate 24, an intermediate vertical plate 25 and an outdoor side transverse plate 26, which cooperate to provide a step-like configuration in which an upper surface of the indoor side portion of the lower frame member 2 is at a level higher than an upper surface of the outdoor side portion thereof. An indoor side lower rail 27 is integrally formed with the indoor side transverse plate 24. Thus, the indoor side sash 5 is slidable in the width direction of the window frame 4 along the indoor side upper rail 22 and the indoor side lower rail 27.

As shown in FIG. 2, the upper frame element 12 of the outdoor side sash 6 is fixed by means of screws 28 to the transverse plate 20 of the upper frame member 1 at an outdoor side portion thereof, and the lower frame element 13 of the outdoor side sash 6 is fixed by means of screws 31 to a frame element 30 which is fixed by means of screws 29 to both the intermediate vertical plate 25 and the outdoor side transverse plate 26. The end frame element 14 of the outdoor side sash 6 is, as shown in FIG. 3, fixed by means of screws 32 to one lateral side vertical frame member 3 at an outdoor side portion thereof.

Figure 3:
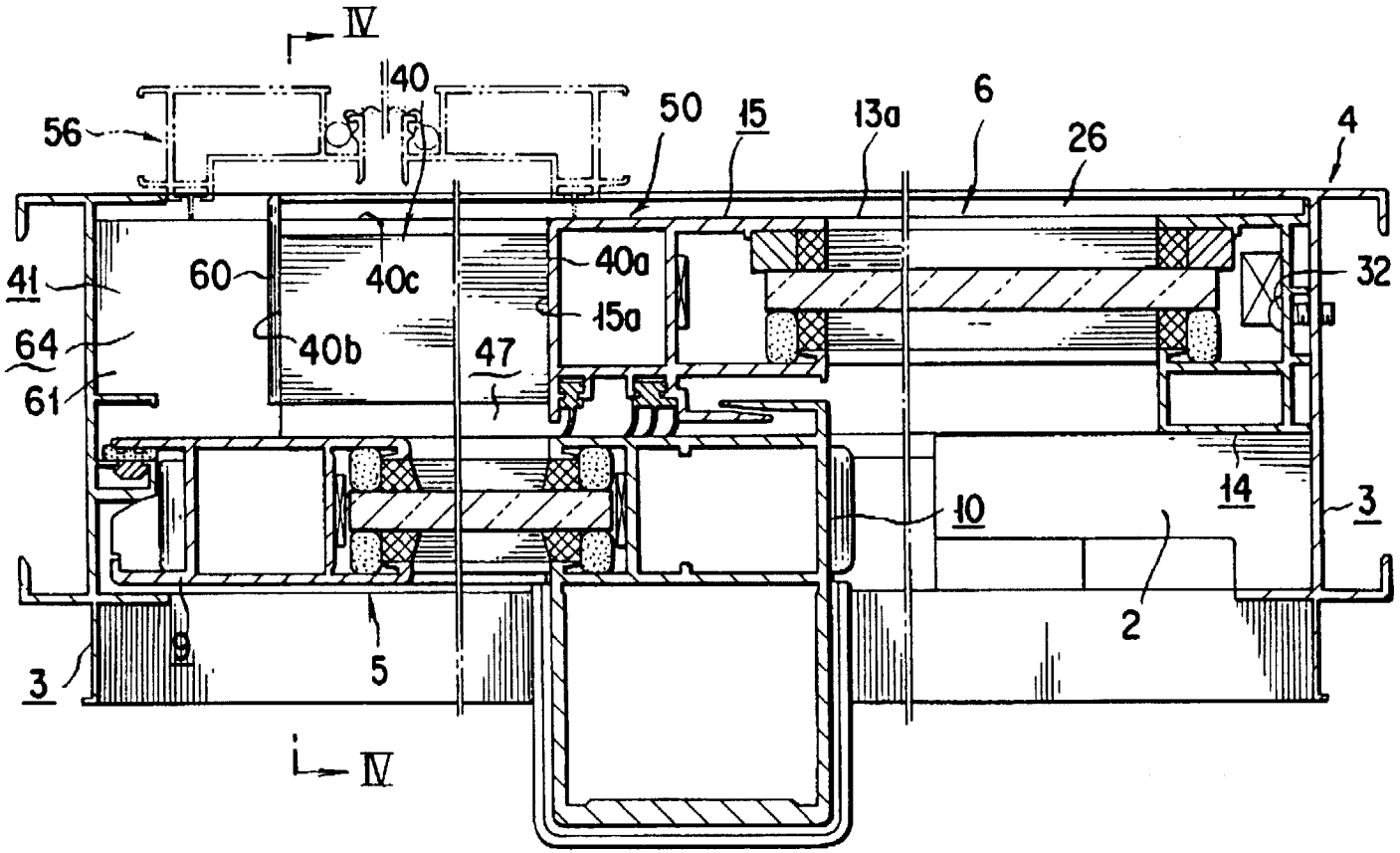
FIG. 3 is a horizontal sectional view of the window structure of FIG. 1.

As shown in FIG. 3, an attachment 40 is mounted on the outdoor side transverse plate 26 of the lower frame member 2 on the lateral one side opposite to that occupied by the outdoor side sash 6 (the left side according to FIG. 3). One longitudinal end face 40*a* of the attachment 40 is in contact with one lateral side face 15*a* of the mating frame element 15 of the outdoor side sash 6, and the other longitudinal end face 40*b* of the attachment 40 is separated from the vertical frame member 3. An end cover 41 is attached to this end face 40*b*.

Figure 4:
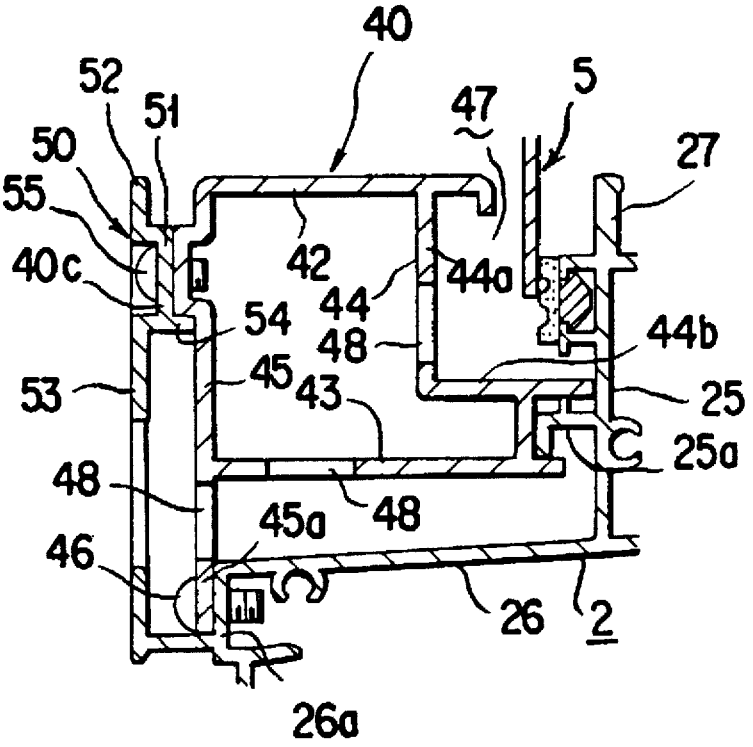
FIG. 4 is a sectional view of the window structure taken along the line IV—IV of FIG. 3.

As shown in FIG. 4, the attachment 40 is a member composed of an upper transverse plate 42, a lower transverse plate 43, an indoor side vertical plate 44 and an outdoor side vertical plate 45 which cooperate to define an inner hollow portion substantially rectangular in section. The indoor side vertical plate 44 has an upper vertical portion 44*a* and a lower transverse portion 44*b*, thereby having substantially L-shaped section. The lower transverse portion 44*b* is mounted on and engaged with a receiving piece 25*a* which is integrally formed to the lower portion of the intermediate vertical plate 25 of the lower frame member 2. The outdoor side vertical plate 45 projects downward beyond the lower transverse plate 43, and the projecting portion 45*a* thereof is fixed by means of screws 46 to an outdoor side step portion 26*a* of the outdoor side transverse plate 26 of the lower frame member 2.

The upper transverse plate 42 is so arranged to slightly project to the indoor side beyond the upper vertical portion 44*a* of the indoor side vertical plate 44 and to be separated from the indoor side lower rail 27 and the intermediate vertical plate 25 of the lower frame member 2. Thus, an upwardly opening recessed portion 47 capable of receiving an outdoor side lower portion of the indoor side sash 5 is defined by the indoor side vertical plate 44, the indoor side lower rail 27 and the intermediate vertical plate 25, through which the indoor side sash 5 can slide or move in the width direction of the window frame without colliding with the attachment 40.

An upper surface of the upper transverse plate 42 of the attachment 40 is substantially at the same height level as an upper end of the indoor side lower rail 27 of the lower frame member 2. Thus, on the lateral one side of the window frame opposite to that occupied by the outdoor side sash 6, the lower frame member 2 has an upper surface substantially at the same height level from the indoor side to the outdoor side thereof in the depth direction of the window frame. Therefore, a person who opens the indoor side sash 5 to go in or out of the room can easily go in or out, and a person on a wheelchair can also go in or out smoothly.

Drip holes or drain ports 48 are formed to the upper vertical portion **44*a* of the indoor side vertical plate 44, the lower transverse plate 43 and the lower projecting portion 45*a* of the outdoor side vertical plate 45 of the attachment 40, respectively, so that rain water or dew water staying in the upwardly opening recessed portion 47** is drained outward therethrough.

As shown in FIGS. 2, 3 and 4, a wire screen lower rail 50 is fixed by means of screws along the outdoor side surface **13*a* of the lower frame element 13 of the outdoor side sash 6 and the outdoor side surface 40*c* (outdoor side vertical plate 45) of the attachment 40. The wire screen lower rail 50 is composed of an attachment vertical piece 51, an L-shaped upper vertical piece 52, an L-shaped lower vertical piece 53 and a projection piece 54 as shown in detail in FIG. 4. The vertical position of the wire screen lower rail 50 is determined by the projection piece 54, and the wire screen lower rail 50 is, with the attachment vertical piece 51 thereof, fixed by means of screws 55. An upper end of the upper vertical piece 52 of the wire screen lower rail 50 is substantially at the same height level as the upper end of the indoor side lower rail 27**.

Thus, as shown in FIG. 2, the wire screen 56 can be mounted on the outdoor side of the window frame 4 so that a lower guide portion 57 of the wire screen 56 is slidably guided by the upper vertical piece 52 of the wire screen lower rail 50 and an upper guide portion 58 of the wire screen 56 is slidably guided by the outdoor side vertical plate 23 of the upper frame member 1. At that time, a lower portion of the wire screen 56 is substantially at the same height level as the indoor side lower rail 27.

Furthermore, as shown in FIG. 2, an L-shaped member 59 may be fixed to the lower vertical piece 53 of the wire screen lower rail 50 by means of screws, and a floor member of a veranda or balcony may be fixed to the L-shaped member 59.

Figure 5:
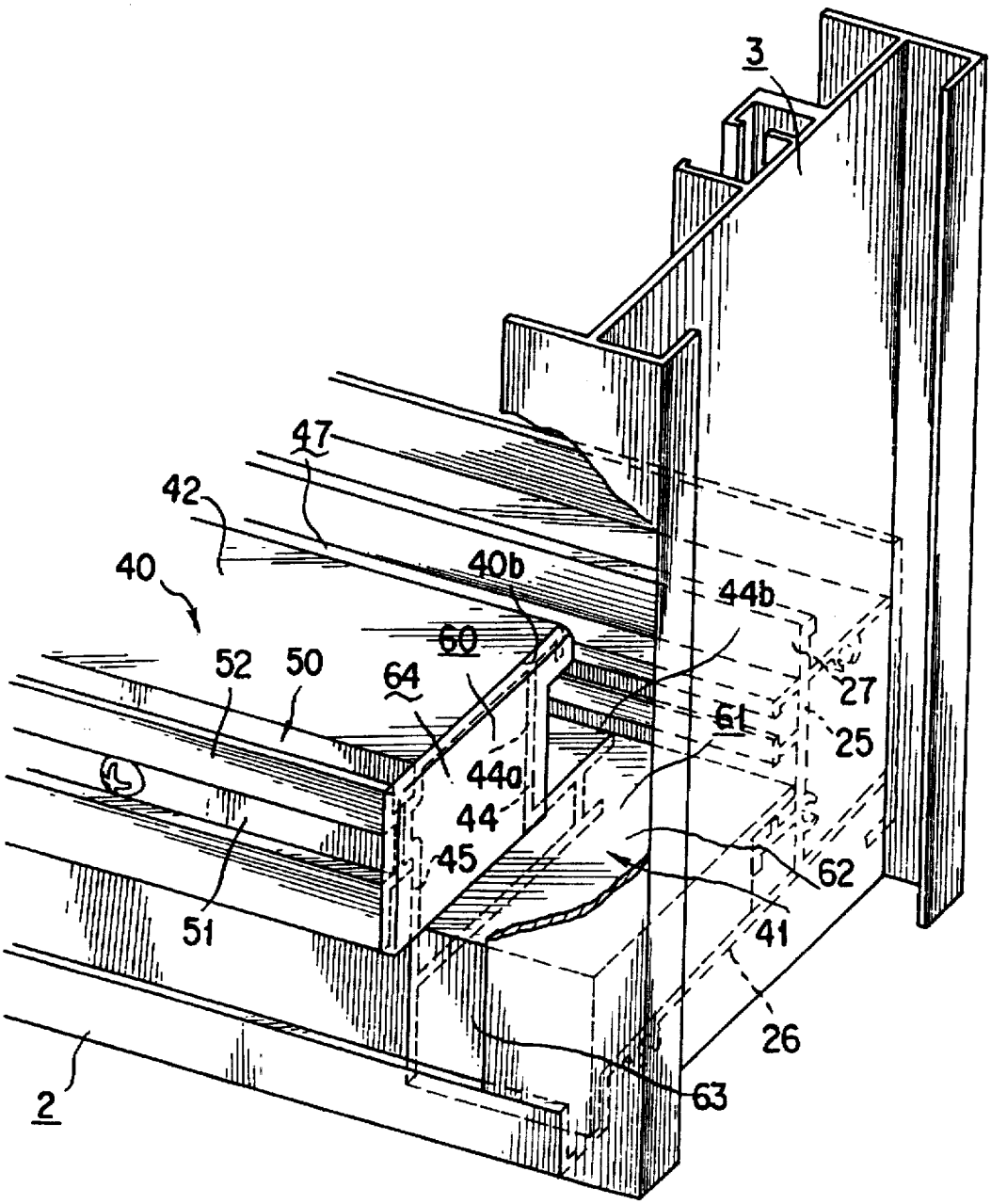
FIG. 5 is a perspective view showing an end cover for a lower frame member of the window structure.

As shown in FIG. 5, the end cover 41 is composed of an upper cover body 60 and a lower cover body 61. The upper cover body 60 has a form of a vertical plate covering the end face of the upper transverse plate 42, an end face of the upper vertical portion **44*a* of the indoor side vertical plate 44, an upper end face of the outdoor side vertical plate 45 of the attachment 40 and an end face of the wire screen lower rail 50. The upper cover body 60 is separated from the vertical frame member 3**.

The lower cover body 61 is formed integrally at the lower portion of the upper cover body 60. The lower cover body 61 has a transverse portion 62 and a vertical portion 63, thereby having substantially L-shaped section, and covers an end face of the lower transverse portion **44*b* of the indoor side vertical plate 44 and a lower end face of the outdoor side vertical plate 45 of the attachment 40. The transverse portion 62 and the vertical portion 63 of the lower cover body 61 are in contact with the vertical frame member 3, thereby defining an upwardly opening recessed portion 64 between the vertical frame member 3 and the end face 40*b* of the attachment 40. The transverse portion 62 is at the same height level as the lower transverse portion 44*b* of the indoor side vertical plate 44 and is continuous to the lower transverse portion 44*b*. Thus, the upwardly opening recessed portion 64 is continuous to the upwardly opening recessed portion 47 mentioned before. Therefore, dust or dirt staying in the upwardly opening recessed portion 47 can be removed through the upwardly opening recessed portion 64**.

Figure 6:
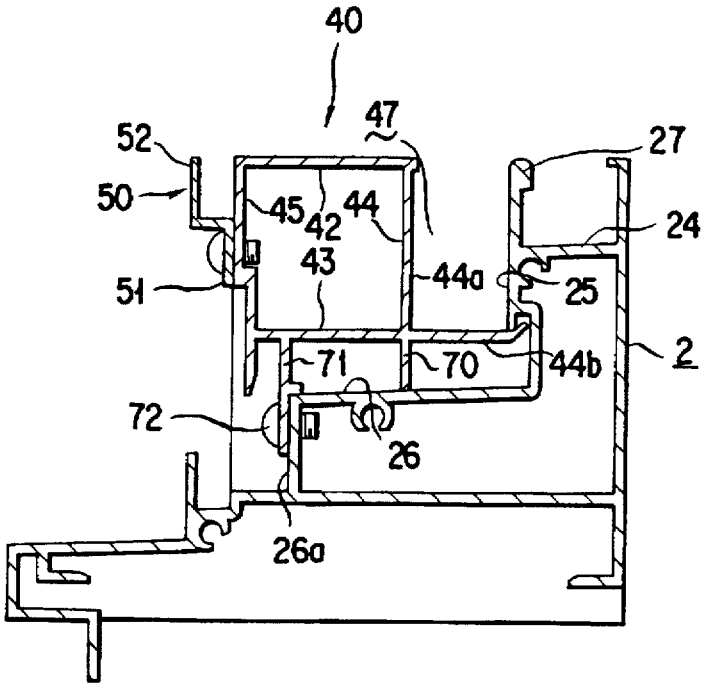
FIG. 6 is a vertical sectional view showing a portion of the lower frame member of the window structure according to a second embodiment of the present invention.

FIG. 6 shows a second embodiment of the present invention, in which a support piece 70 and an attachment piece 71 are integrally formed with the lower transverse plate 43 of the attachment 40 so as to project downwardly therefrom. The attachment 40 is mounted to the lower frame member 2 in such manner that the support piece 70 is in contact with the outdoor side transverse plate 26 of the lower frame member 2, and the attachment piece 71 is fixed to the step portion **26*a* of the outdoor side transverse plate 26 by means of screws 72. Cutouts are formed to the lower transverse portion 44*b* of the indoor side vertical plate 44, the support piece 70 and the attachment piece 71, respectively, so that rain water or dew water staying in the upwardly opening recessed portion 47 is drained outward without passing through the inner hollow portion of the attachment 40**.

Figure 7:
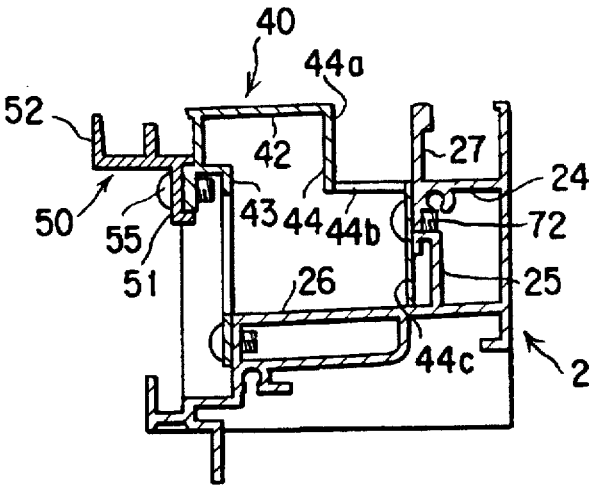
FIG. 7 is a vertical sectional view showing a portion of the lower frame member of the window structure according to a third embodiment of the present invention.

FIG. 7 shows a third embodiment of the present invention, in which an indoor side vertical plate 44 of the attachment 40 has the upper vertical portion **44*a*, the lower transverse portion 44*b* and the lower vertical portion 44*c* which cooperate to have a crank-like section. Therefore, in this embodiment, a lower transverse plate 43 is eliminated from the attachment 40. The attachment 40 is, with the vertical portion 44*c* thereof, fixed to the intermediate vertical plate 25 of the lower frame member 2 by means of screws 73 and defines an inner hollow portion in cooperation with the upper surface of the lower frame member 2**.

The present invention was described hereinbefore with respect to the preferred embodiments of the inside single sliding window structure. Next, the present invention will be described with respect to the embodiments of various types of sliding window structures, i.e., an inside single sliding structure, an outside single sliding structure and a double sliding window structure, which are formed by utilizing existing sliding window structures.

Figure 8:
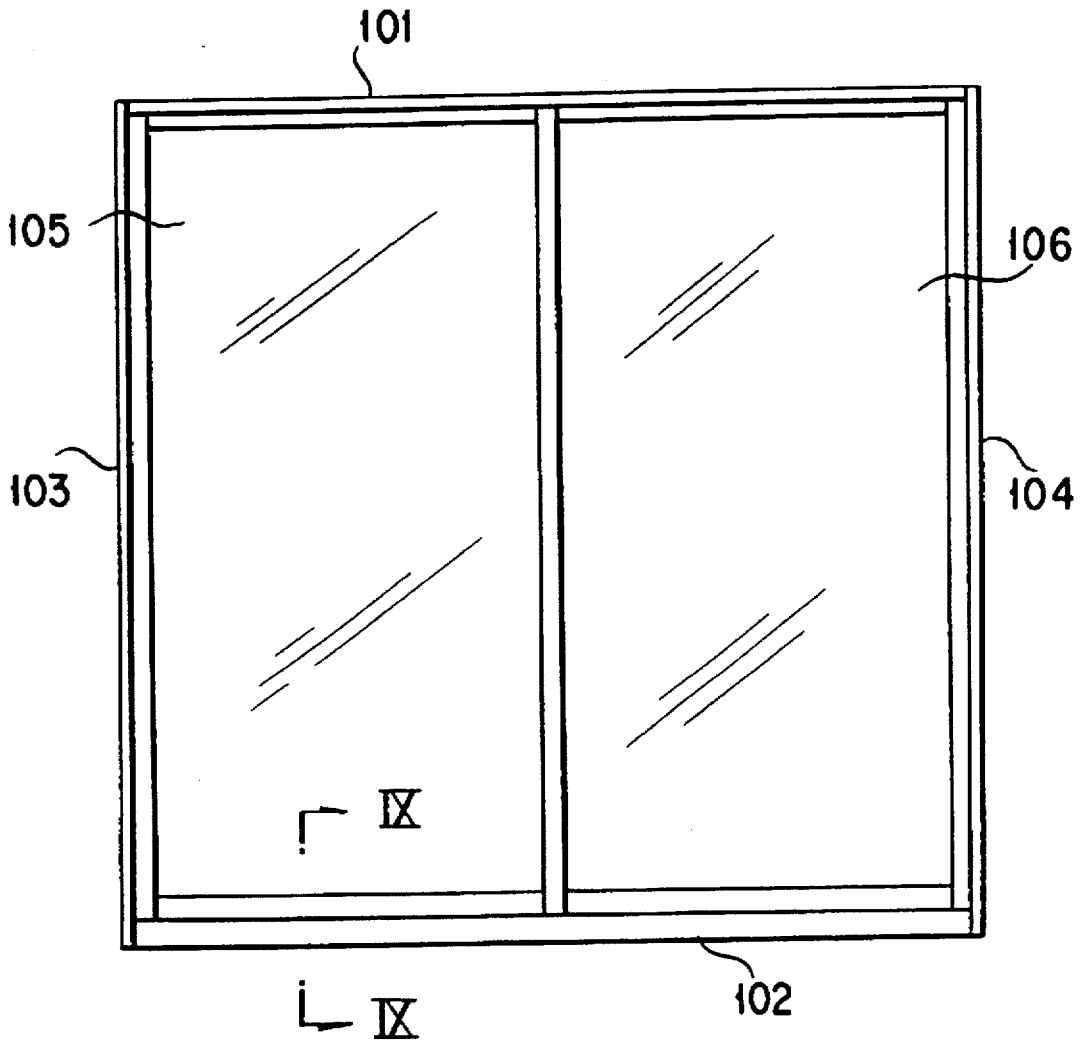
FIG. 8 is a schematic front view of a double sliding window structure according to a fourth embodiment of the present invention.
Figure 9:
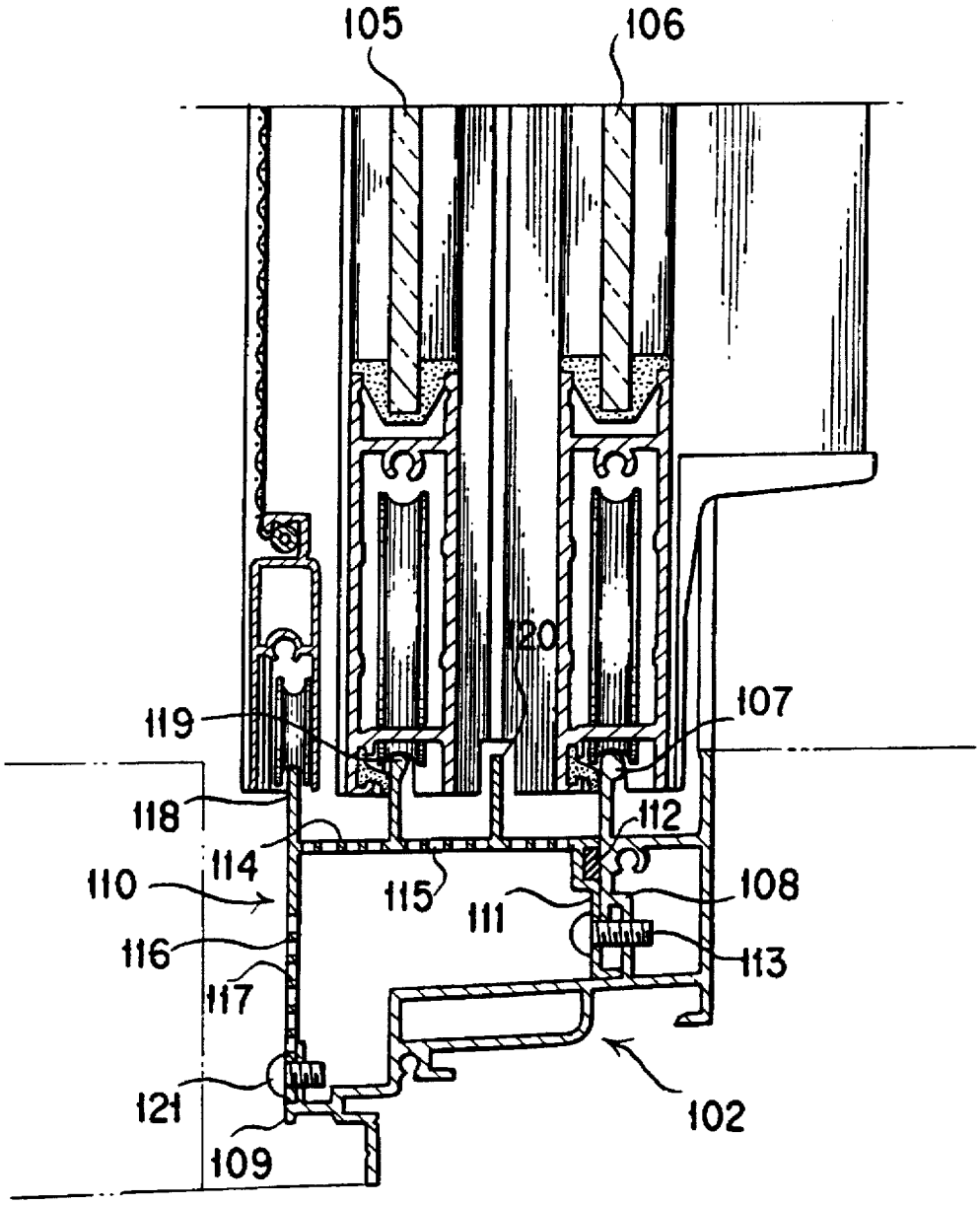
FIG. 9 is a vertical sectional view of the window structure taken along the line IX—IX of FIG. 8.

FIGS. 8 and 9 show a fourth embodiment of the present invention, in which a double sliding window structure is formed by utilizing an existing inside single sliding window structure.

As shown in FIG. 8, the double sliding window structure according to the fourth embodiment of the present invention has a window frame comprising an upper frame member 101, a lower frame member 102 and bilateral side vertical frame members 103, 104 which are assembled in rectangular shape, to which an indoor side sash 106 and an outdoor side sash 105 are fitted so as to be slidable in a width direction of the window frame, respectively.

The lower frame member 102 is a lower frame member of an existing inside single sliding structure. As shown in FIG. 9, the lower frame member 102 comprises an indoor side portion to which an indoor side sash is mounted and an outdoor side portion to which an outdoor side sash is mounted and has a step-like configuration in which the indoor side portion has a height higher than a height of the outdoor side portion. At the indoor side portion of the lower frame member 102, a rail 107 is formed integrally. At the outdoor side portion thereof, a frame element for mounting and fixing a sash therein is originally attached.

As shown in FIG. 9, according to this embodiment of the present invention, the frame element originally attached to the outdoor side portion of the lower frame member 102 is removed therefrom, and instead, an attachment 110 formed with a rail 119 is mounted to the lower frame member 102 so as to cover the outdoor side portion thereof. The rail 119 of the attachment 110 has substantially the same configuration as that of the rail 107 of the lower frame member 102, and an upper end of the rail 119 is substantially at the same height level as an upper end of the rail 107 when the attachment 110 is mounted to the lower frame member 102. The indoor side sash 106 is mounted on the rail 107 and the outdoor side sash 105 is mounted on the rail 119, thereby constituting a double sliding window structure.

As shown in FIG. 9, the attachment 110 comprises an upper transverse plate 114, an indoor side vertical plate 111 and an outdoor side vertical plate 116, thereby having an inverted U-shaped section, and has a longitudinal length substantially the same as a longitudinal length of the lower frame member 102. A rail 118 for a wire screen, a rail 119 for a sash and a partition piece 120 are integrally formed to the upper transverse plate 114 so as to project therefrom. The indoor side vertical plate 111 is fixed to a side wall 108 of the lower frame member 102 below the rail 107, holding an air-tight member 112 therebetween, by means of screws 113. The outdoor side vertical plate 116 is fixed to an outdoor side lower end portion 109 of the lower frame member 102 by means of screws 121. A plurality of drain ports 115 and a plurality of drain ports 117 are formed to the upper transverse plate 114 and a lower end portion of the outdoor side vertical plate 116, respectively, so that rain water invading into a space between the indoor side sash and the outdoor side sash is drained outward therethrough.

As described above, according to this embodiment, since the upper ends of the rails 107 and 119 on which the indoor side and outdoor side sashes 106 and 105 are mounted are substantially at the same height level, a person on a wheelchair can smoothly pass over.

Figure 10:
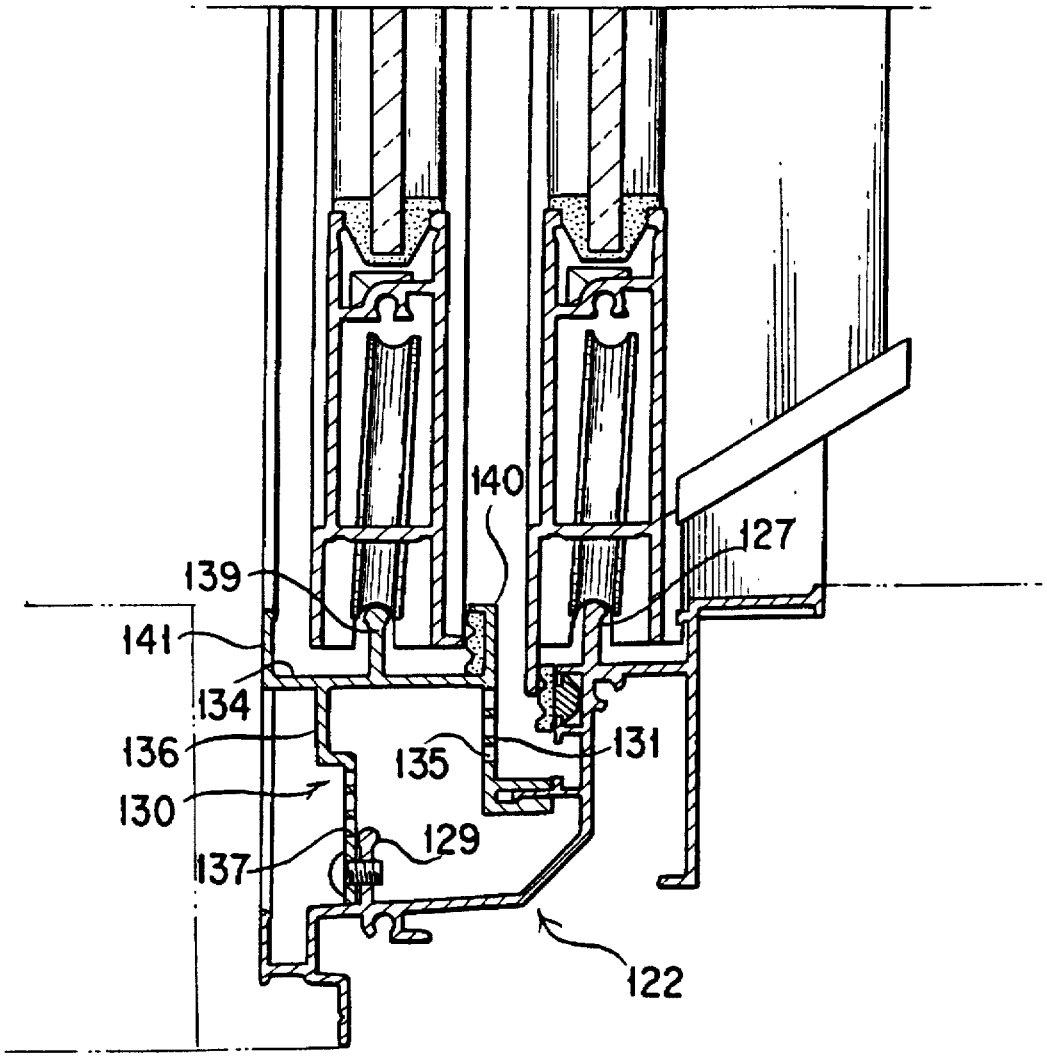
FIG. 10 is a vertical sectional view of a double sliding window structure according to a fifth embodiment of the present invention.

FIG. 10 shows a fifth embodiment of the present invention, in which a double sliding window structure is formed by utilizing an existing double sliding window structure.

The lower frame member 122 is a lower frame member of an existing double sliding window structure. As seen in FIG. 10, the lower frame member 102 comprises an indoor side portion to which an indoor side sash is mounted and an outdoor side portion to which an outdoor side sash is mounted and has a step-like configuration in which the indoor side portion has a height higher than a height of the outdoor side portion. Rails 127 and 129 are integrally formed at the indoor side and outdoor side portions of the lower frame member 122, respectively. An upper end of the rail 127 is at a level higher than an upper end of the rail 129.

As shown in FIG. 10, according to this embodiment of the present invention, an attachment 130 formed with a rail 139 is mounted to the lower frame member 122 so as to cover the outdoor side portion thereof. The rail 139 of the attachment 130 has substantially the same configuration as that of the rail 127 of the lower frame member 122, and an upper end of the rail 139 is substantially at the same height level as an upper end of the rail 127 when the attachment 130 is mounted to the lower frame member 122. The indoor side sash is mounted on the rail 127 and the outdoor side sash is mounted on the rail 139, thereby constituting a double sliding window structure.

As shown in FIG. 10, the attachment 130 comprises an upper transverse plate 134, an indoor side vertical plate 131 and an outdoor side vertical plate 136, and has a longitudinal length substantially the same as a longitudinal length of the lower frame member 122. Indoor side and outdoor side partition pieces 140 and 141 are formed at indoor side and outdoor side portions of the upper transverse plate 134, and a rail 139 is formed at a central portion thereof. The indoor side and outdoor side partition pieces 140 and 141 and the rail 139 are all formed integrally to the upper transverse plate 134 so as to project upwardly therefrom, and have substantially the same longitudinal length as that of the lower frame member 122. The indoor side vertical plate 131 is formed to the indoor side portion of the upper transverse plate 134, and is engaged with and fixed to the lower frame member 122 below the rail 127. The outdoor side vertical plate 136 is formed at an outdoor side portion of the upper transverse plate 134 slightly toward the indoor side, and is fixed to the rail 129 of the lower frame member 122 by means of screws. A plurality of drain ports 135 and a plurality of drain ports 137 are formed to the indoor side vertical plate 131 and a lower portion of the outdoor side vertical plate 136, respectively, so that rain water invading into a space between the indoor side and outdoor side sashes is drained outward therethrough.

As described above, according to this embodiment, since the upper ends of the rails 127 and 139 on which the indoor side and outdoor side sashes are mounted are substantially at the same height level, a person on a wheelchair can smoothly pass over.

FIGS. 11 to 14 show a sixth embodiment of the present invention, in which an outside single sliding window structure is formed by utilizing an existing outside single sliding window structure.

Figure 11:
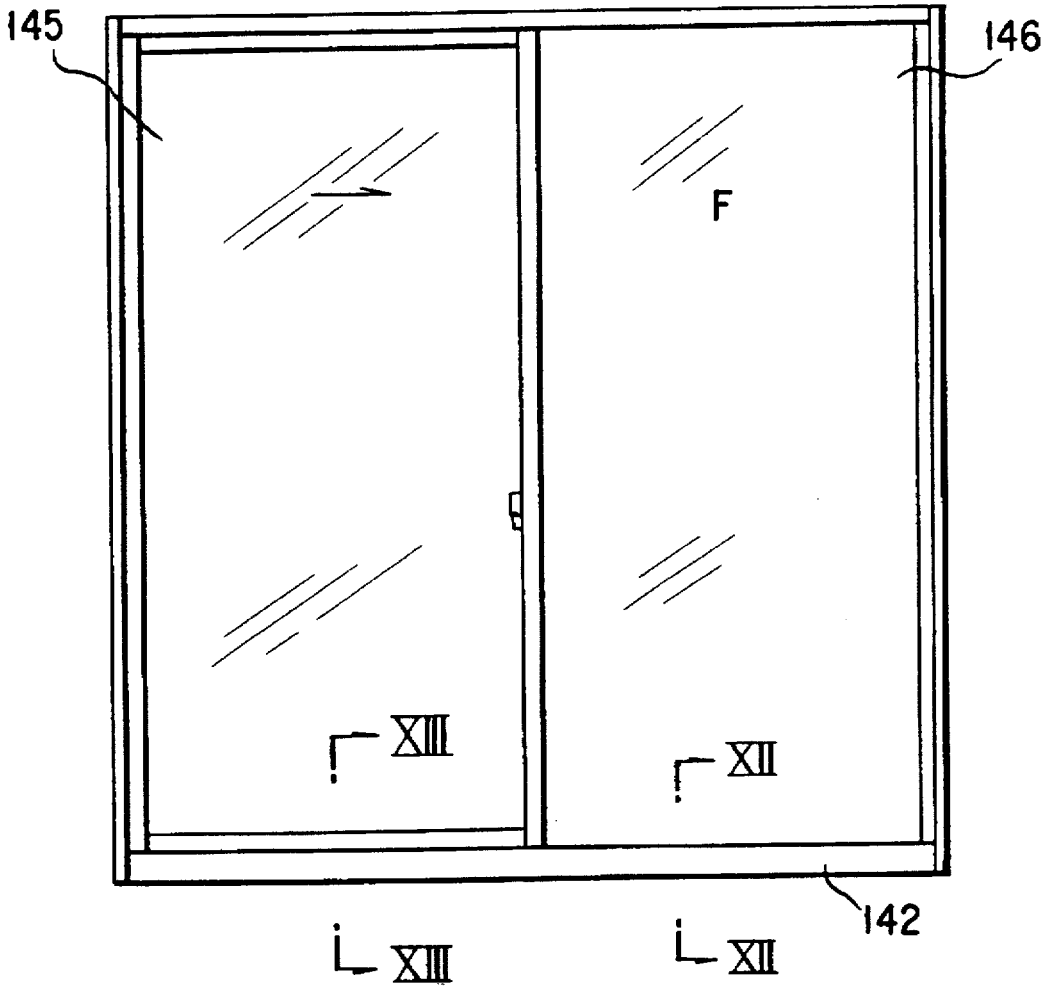
FIG. 11 is a schematic front view of an outside single sliding window structure according to a sixth embodiment of the present invention.

As shown in FIG. 11, in the outside single sliding window structure according to the sixth embodiment of the present invention, an indoor side sash 146 is fitted at an indoor side portion of the window frame so as to be fixed to one of the laterally left and right sides (the right side according to FIG. 11) of the window frame, and an outdoor side sash 145 is fitted at an outdoor side portion of the window frame so as to be slidable in a width direction of the window frame.

Figure 12:
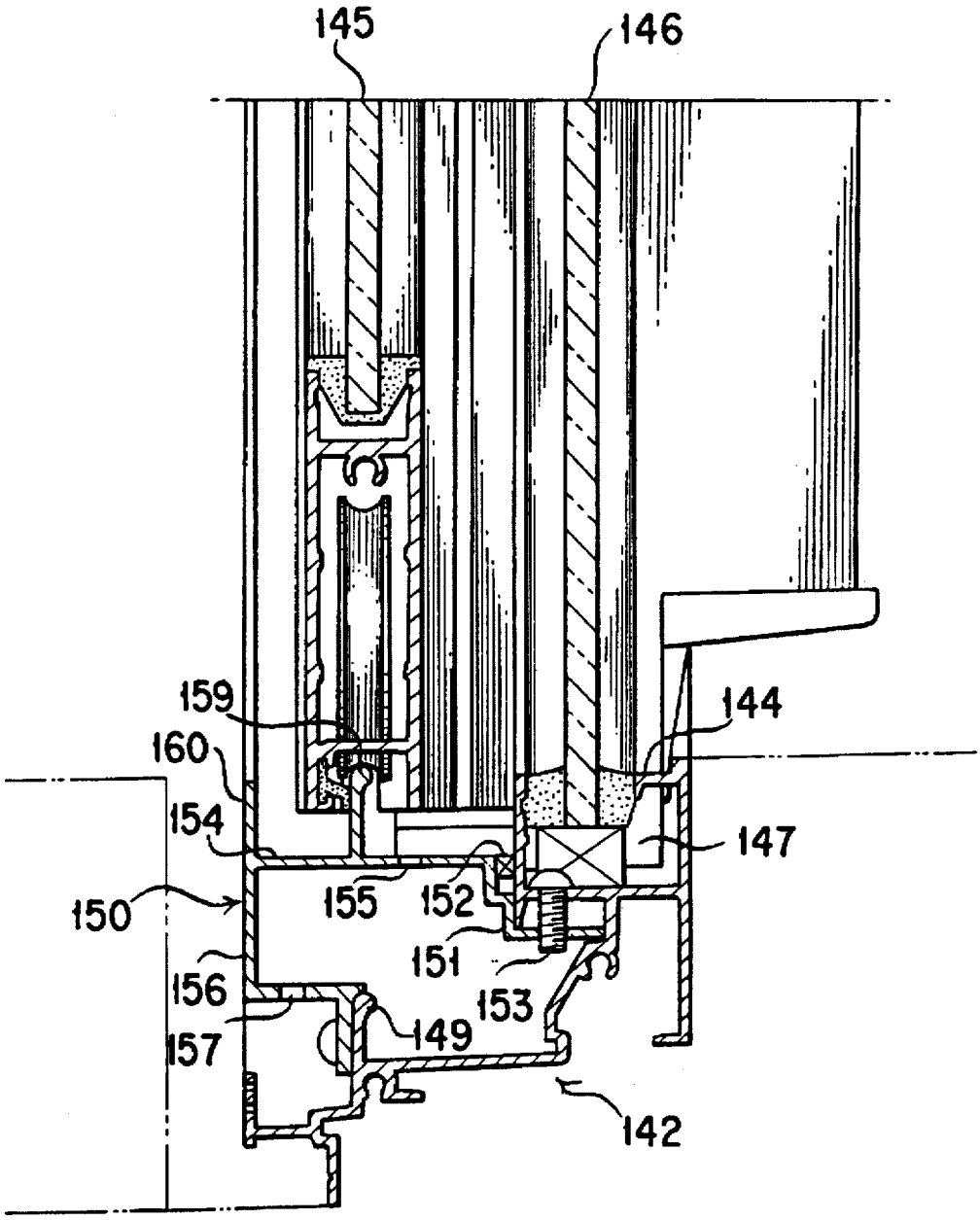
FIG. 12 is a vertical sectional view of the window structure taken along the line XII—XII of FIG. 11.

The lower frame member 142 is a lower frame member of an existing outside single sliding structure. As shown in FIG. 12, the lower frame member 142 comprises an indoor side portion to which an indoor side sash is mounted and an outdoor side portion to which an outdoor side sash is mounted and has a step-like configuration in which the indoor side portion has a height higher than a height of the outdoor side portion. At the indoor side portion of the lower frame member 142, a mounting groove 147 for mounting and fixing a sash therein is formed integrally, over the entire longitudinal length of the lower frame member 142. At the outdoor side portion of the lower frame member 142, a rail 149 is integrally formed.

Figure 13:
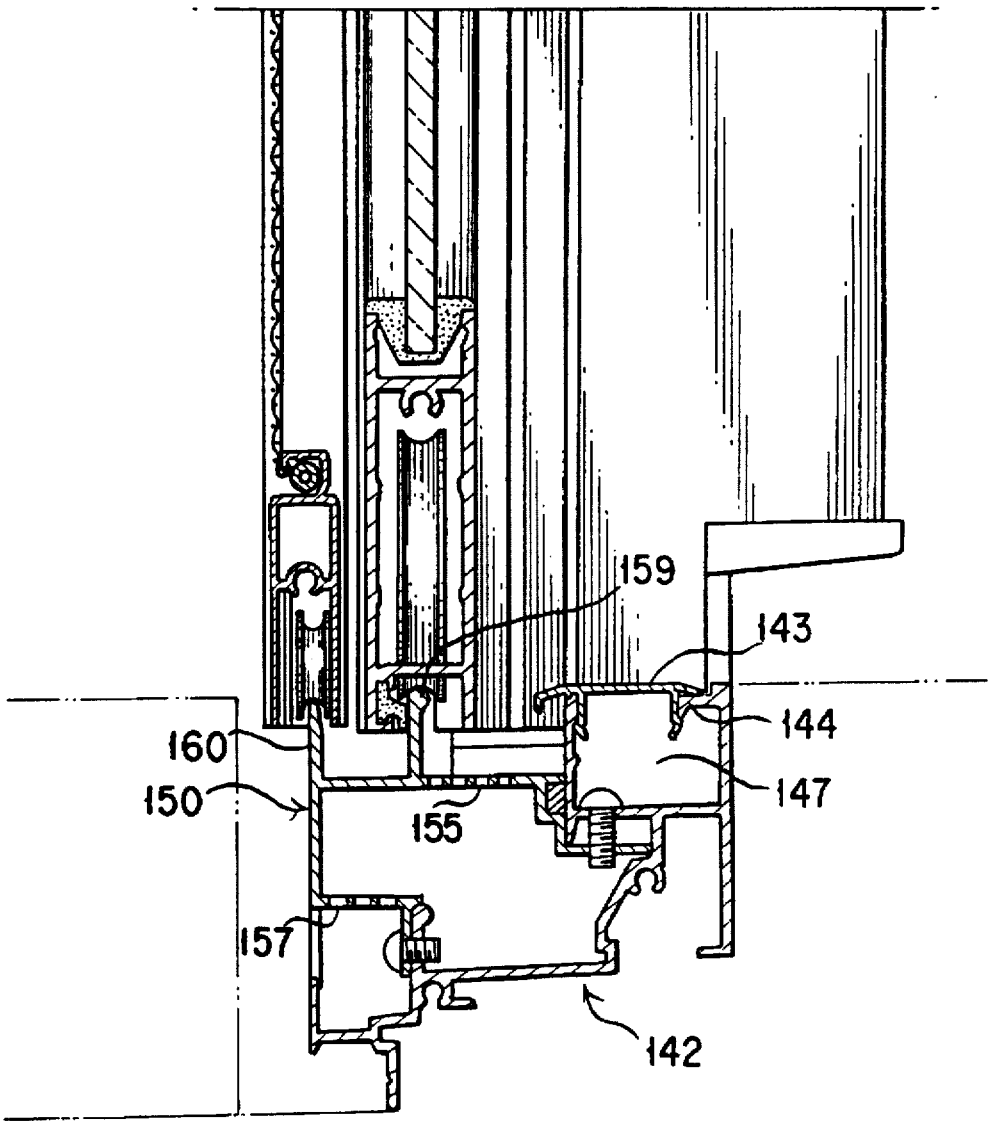
FIG. 13 is a vertical sectional view of the window structure taken along the line XIII—XIII of FIG. 11.

As shown in FIG. 12, according to this embodiment of the present invention, an attachment 150 formed with a rail 159 is mounted to the lower frame member 142 so as to cover the outdoor side portion thereof. As shown in FIG. 13, an upper end of the rail 159 of the attachment 150 is substantially at the same height level as an upper end 144 of the mounting groove 147 of the lower frame member 142 when the attachment 150 is mounted to the lower frame member 142. The indoor side sash 146 is mounted and fixed in the mounting groove 147 on one of the laterally left and right sides of the window frame, and the outdoor side sash 145 is mounted on the rail 159, thereby constituting a outside single sliding window structure.

As shown in FIG. 12, the attachment 150 comprises an upper transverse plate 154, an indoor side mounting wall piece 151 and an outdoor side vertical wall piece 156, and has a longitudinal length substantially the same as a longitudinal length of the lower frame member 142. The rail 159 is formed at a central portion of the upper transverse plate 154, and a partition piece 160 is formed at an outdoor side end portion thereof. The rail 159 and the partition pieces 160 are both formed integrally to the upper transverse plate 154 so as to project upwardly therefrom, and have substantially the same longitudinal length as that of the lower frame member 142. The indoor side mounting wall piece 151 is formed to the indoor side portion of the upper transverse plate 154, and is fixed by means of screws 153 to a bottom portion of the mounting groove 147 of the lower frame member 142, holding an air-tight member 152 therebetween. The outdoor side vertical wall piece 156 is formed to the outdoor side portion of the upper transverse plate 154, and is fixed, with the lower end portion thereof, to the rail 149 of the lower frame member 142 by means of screws. A plurality of drain ports 155 are formed to the upper transverse plate 154 at an indoor side of the rail 159, and a plurality of drain ports 157 are formed to the outdoor side vertical wall piece 156, so that rain water invading into a space between the indoor side and outdoor side sashes is drained outward therethrough.

As described above, at the outdoor side portion of the lower frame member 142, over the entire longitudinal length thereof, the attachment 150 formed with the rail 159 is so mounted that the upper end of the rail 159 is substantially at the same height level as the upper end 144 of the mounting groove 147. On the other hand, at the indoor side portion of the lower frame member 142, if the mounting groove 147 formed over the entire longitudinal length of the lower frame member 142 remains open on the lateral one side of the window frame opposite to that occupied by the indoor side sash 146, it may be an obstacle to the passing of the wheelchair. Therefore, as shown in FIG. 13, a cover 143 is attached to the mounting groove 147 on the lateral one side opposite to that occupied by the indoor side sash 146. The upper surface of the cover 143 is substantially at the same height level as the upper end of the rail 159.

Figure 14:
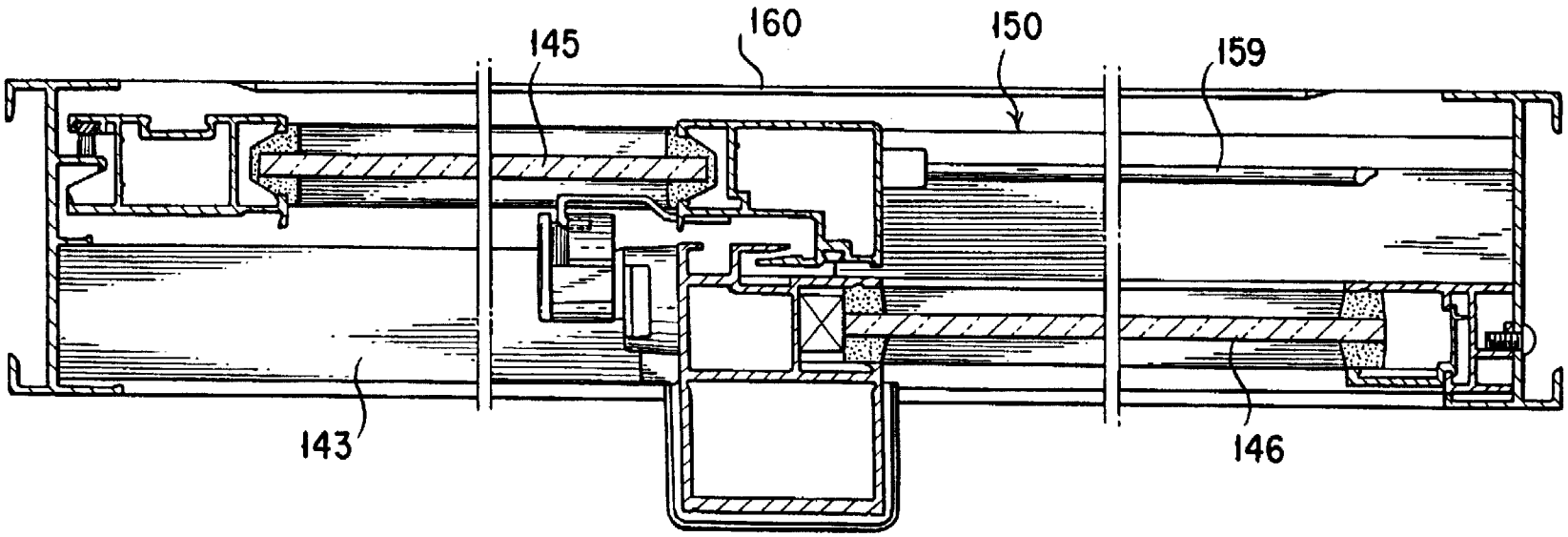
FIG. 14 is a horizontal sectional view of the window structure of FIG. 11.

As shown in FIG. 14, the attachment 150 mounted at the outdoor side portion of the lower frame member 142 has substantially the same longitudinal length as that of the lower frame member 142 in the width direction of the window frame, and the outdoor side sash 145 moves slidably along the rail 159 formed to the attachment 150, thereby opening or closing the window. At the indoor side portion of the lower frame member 142, the mounting groove 147 is formed over the entire longitudinal length thereof, and the indoor side sash 146 is mounted and fixed in the mounting groove 147 on one of the laterally left and right sides (the right side according to FIG. 14) of the window frame so as to occupy substantially half the longitudinal length of the lower frame member 142. The lateral one side opposite to that occupied by the indoor side sash 146 (the left side according to FIG. 14) of the window frame serves as an entrance portion of this window structure through which a person goes in or out. Therefore, the cover 143 is attached to the mounting groove 147 on this side so as to close the portion thereof which would otherwise remain open, thereby allowing a wheelchair to pass over easily.

FIGS. 15 to 18 show a seventh embodiment of the present invention, in which an inside single sliding window structure is formed by utilizing an existing inside single sliding window structure.

Figure 15:
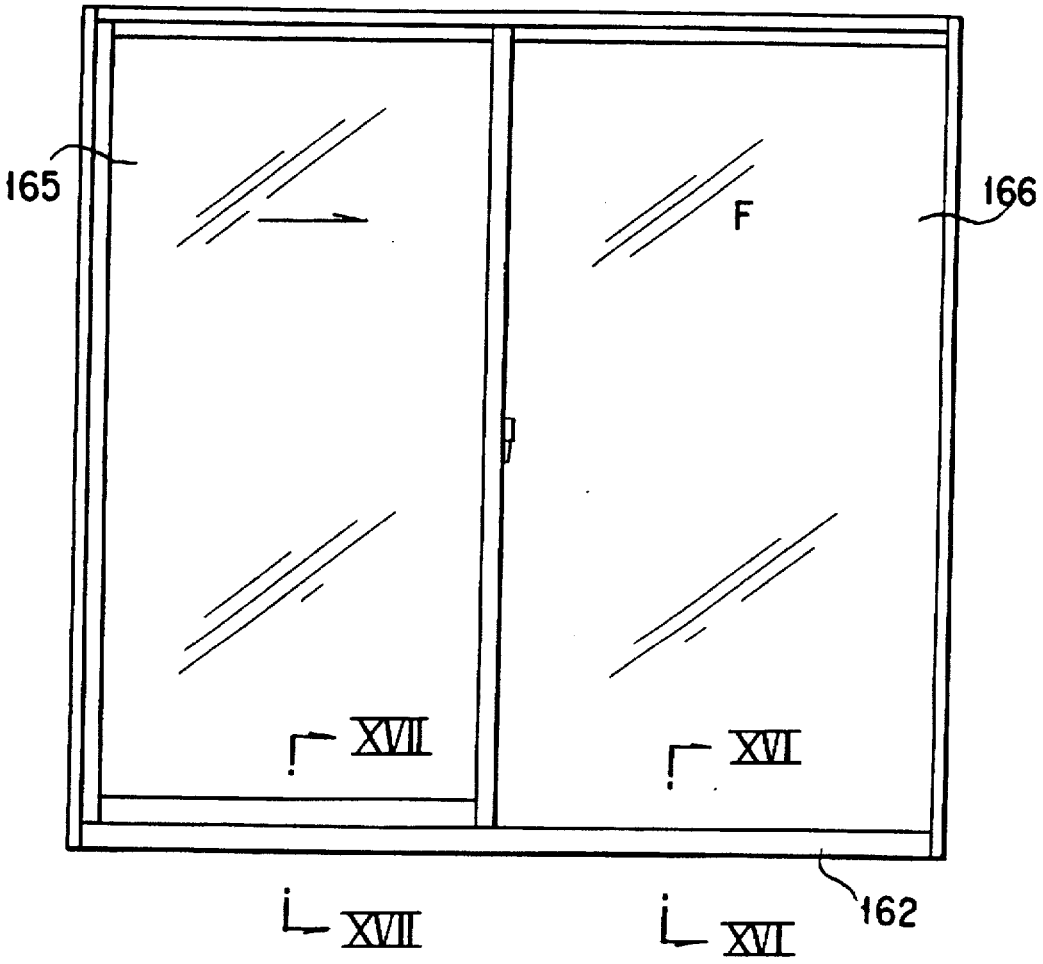
FIG. 15 is a schematic front view of an inside single sliding window structure according to a seventh embodiment of the present invention.

As shown in FIG. 15, in the inside single sliding window structure according to the seventh embodiment of the present invention, an indoor side sash 165 is fitted at an indoor side portion of the window frame so as to be slidable in a width direction of the window frame, and an outdoor side sash 166 is fitted at an outdoor side portion of the window frame so as to be fixed to one of the laterally left and right sides (the right side according to FIG. 15) of the window frame.

Figure 16:
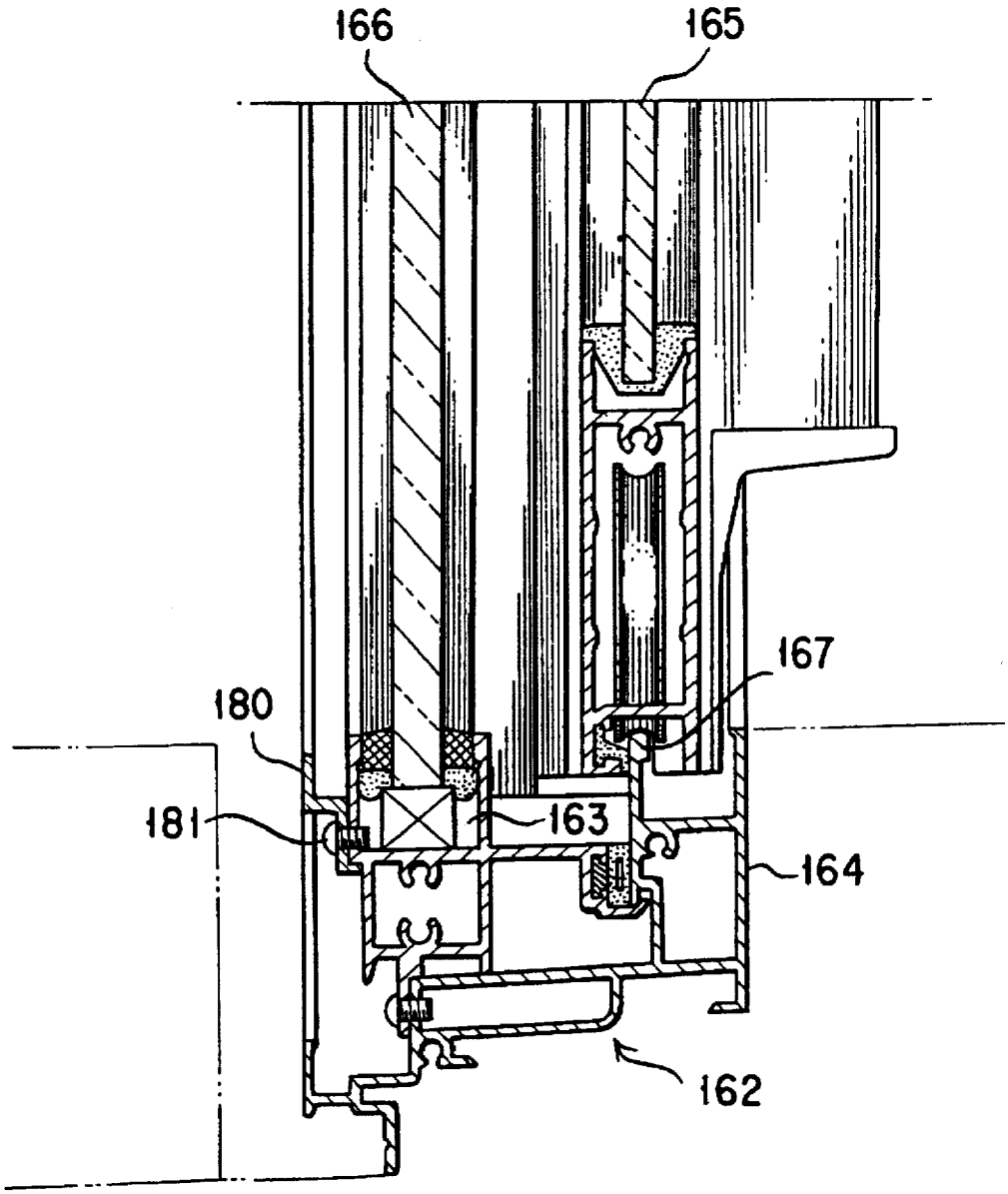
FIG. 16 is a vertical sectional view of the window structure taken along the line XVI—XVI of FIG. 15.

The lower frame member 162 is a lower frame member of an existing inside single sliding window structure. As shown in FIG. 16, the lower frame member 162 comprises an indoor side portion to which an indoor side sash is mounted and an outdoor side portion to which an outdoor side sash is mounted and has a step-like configuration in which the indoor side portion has a height higher than a height of the outdoor side portion. At the indoor side portion of the lower frame member 162, a rail 167 is formed integrally. At the outdoor side portion of the lower frame member 162, a frame element formed with a mounting groove 163 and having a longitudinal length substantially half the longitudinal length of the lower frame member 162 is attached on one of the laterally left and right sides (the right side according to FIG. 15) of the window frame. The indoor side sash 165 is mounted on the rail 167, and the outdoor side sash 166 is mounted and fixed in the mounting groove 163.

Figure 18:
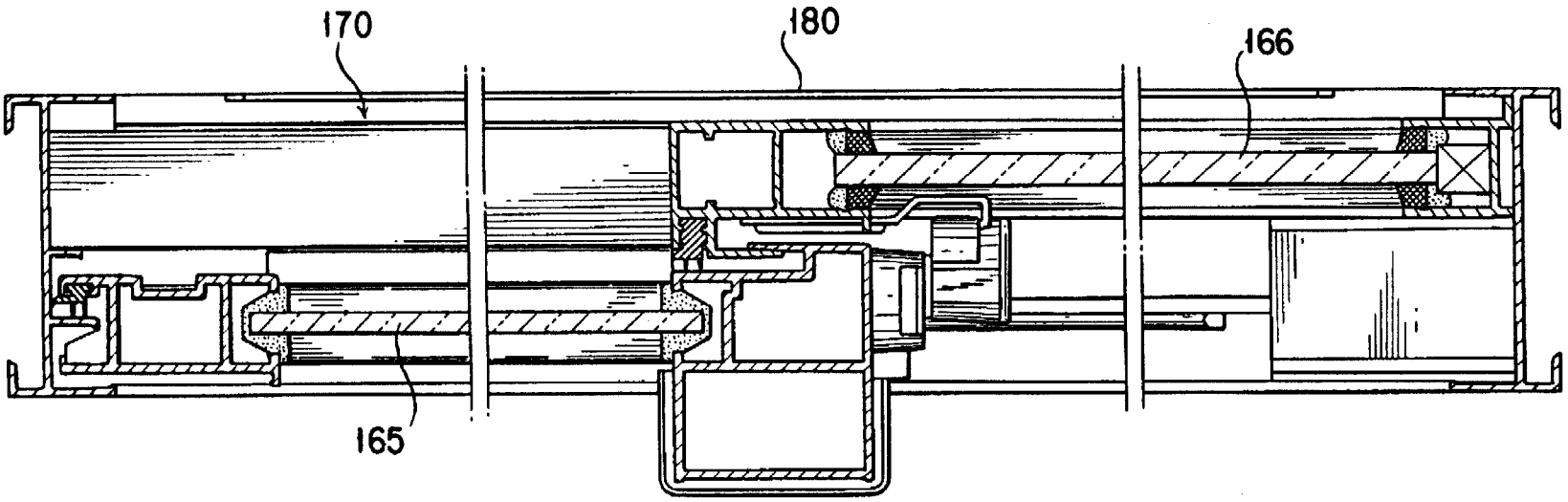
FIG. 18 is a horizontal sectional view of the window structure of FIG. 15.

As shown in FIGS. 16 and 18, according to this embodiment of the present invention, a partition piece 180 is fixed by means of screws 181 to the outdoor side side surface of the mounting groove 163 in such manner that an upper end of the partition piece 180 is substantially at the same height level as an upper end of the rail 167.

Figure 17:
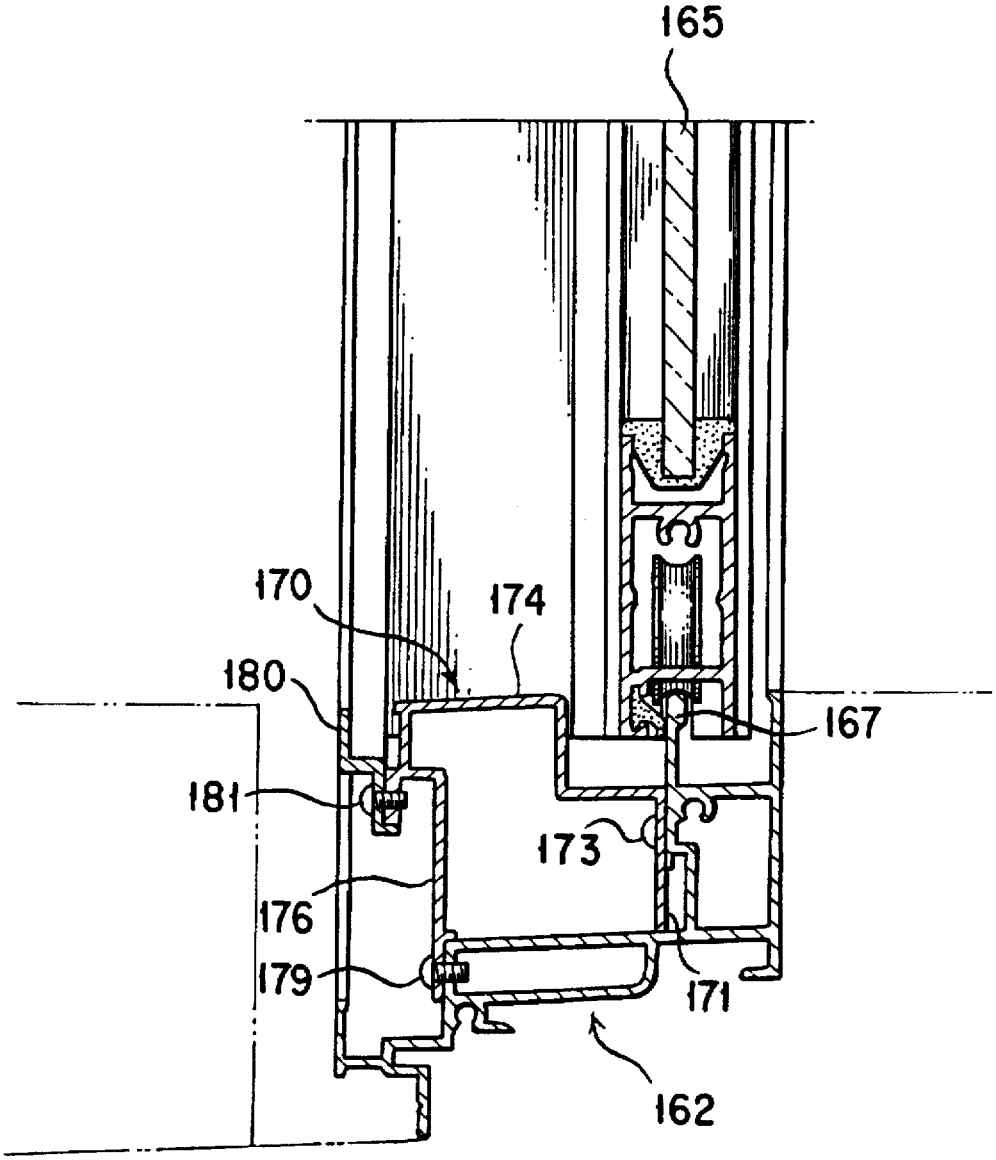
FIG. 17 is a vertical sectional view of the window structure taken along the line XVII—XVII of FIG. 15.

In the existing inside sliding window structure, the space above the outdoor side portion of the lower frame member 162 on the lateral one side opposite to that occupied by the outdoor side sash 166 is vacant. As shown in FIGS. 17 and 18, according to this embodiment of the present invention, an attachment 170 having an upper flat surface and having a longitudinal length substantially half the longitudinal length of the lower frame member 162 is mounted to this vacant space. When the attachment 170 is mounted to the lower frame member 162, the upper surface of the attachment 170 is substantially at the same height level as the upper end of the rail 167 of the lower frame member 167. Thus, a wheelchair can easily go in or out at this portion of the window.

As shown in FIG. 17, the attachment 170 comprises an upper transverse plate 174, an indoor side vertical wall piece 171 and an outdoor side vertical wall piece 176, and has a longitudinal length substantially half the longitudinal length of the lower frame member 162. The indoor side vertical wall piece 171 having a crank-like section is formed to the indoor side portion of the upper transverse plate 174, and is fixed by means of screws 173 to the lower frame member 162 below the rail 167. The outdoor side vertical wall piece 176 is formed to the outdoor side portion of the upper transverse plate 174, and is fixed by means of screws 179 to an outdoor side lower portion of the lower frame member 162. At the upper portion of the side surface of the outdoor side vertical wall piece 176, the partition piece 180 extending over the entire longitudinal length of the lower frame member 162 as mentioned above is fixed by means of screws 181.

FIGS. 19 to 22 show a eighth embodiment of the present invention, in which an inside single sliding window structure is formed by utilizing an existing double sliding window structure.

Figure 19:
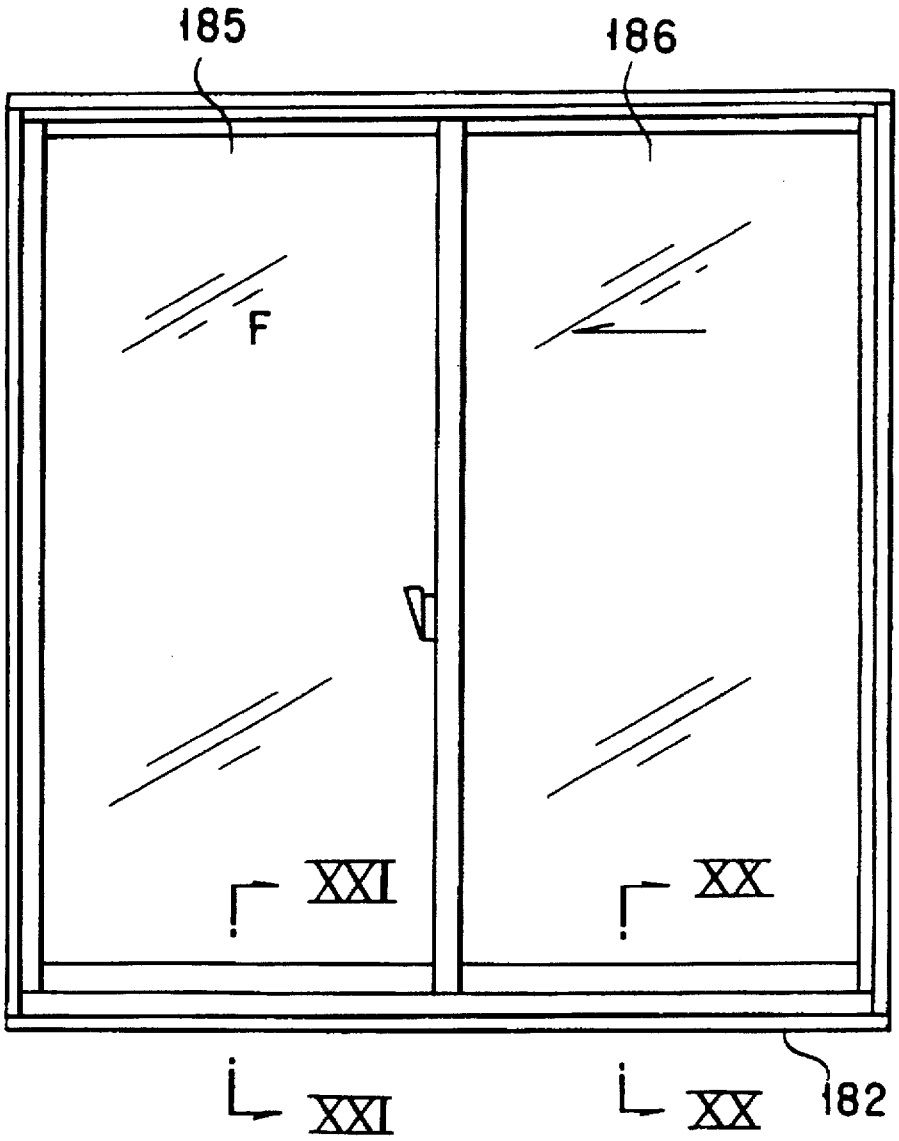
FIG. 19 is a schematic front view of an inside single sliding window structure according to a eighth embodiment of the present invention.

As shown in FIG. 19, in the inside single sliding window structure according to the eighth embodiment of the present invention, an indoor side sash 186 is fitted at an indoor side portion of the window frame so as to be slidable in a width direction of the window frame, and an outdoor side sash 185 is fitted at an outdoor side portion of the window frame so as to be fixed on one of the laterally left and right sides (the left side according to FIG. 19) of the window frame.

Figure 20:
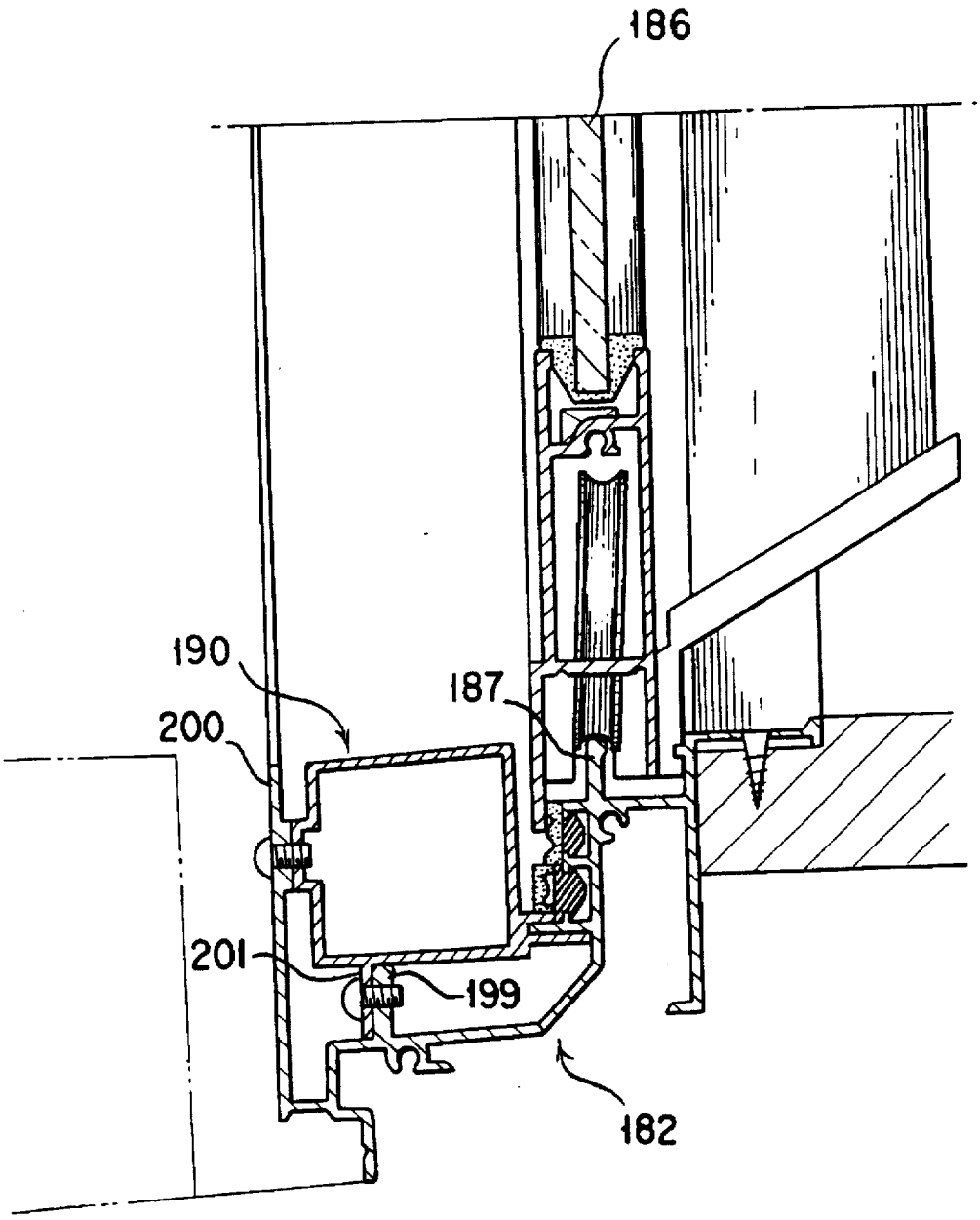
FIG. 20 is a vertical sectional view of the window structure taken along the line XX—XX of FIG. 19.

The lower frame member 182 is a lower frame member of an existing double sliding structure. As shown in FIG. 20, the lower frame member 182 comprises an indoor side portion to which an indoor side sash is mounted and an outdoor side portion to which an outdoor side sash is mounted and has a step-like configuration in which the indoor side portion has a height higher than a height of the outdoor side portion. Rails 187 and 199 are integrally formed at the indoor side and outdoor side portions of the lower frame member 182, respectively. An upper end of the rail 187 is at a level higher than an upper end of the rail 199.

Figure 21:
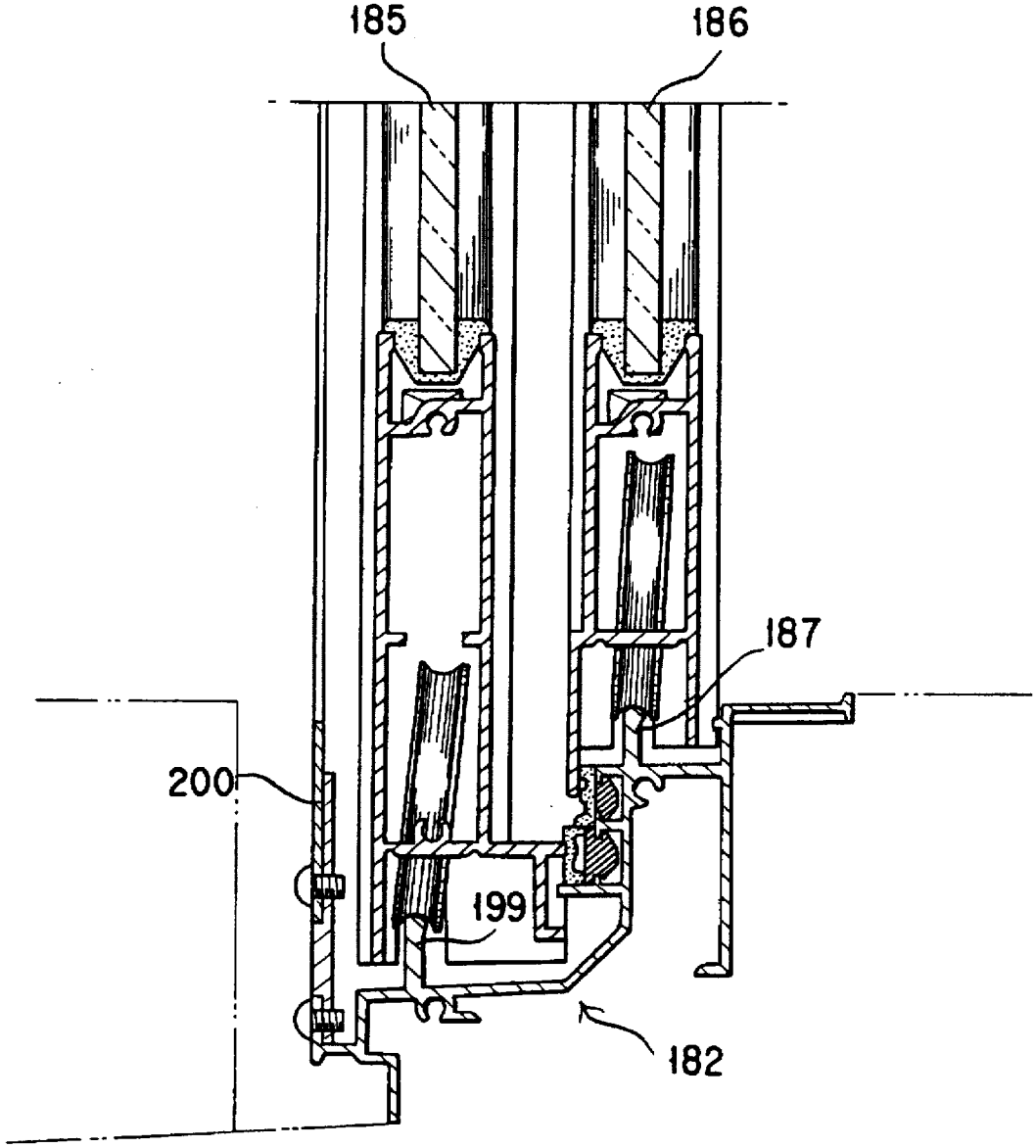
FIG. 21 is a vertical sectional view of the window structure taken along the line XXI—XXI of FIG. 19.
Figure 22:
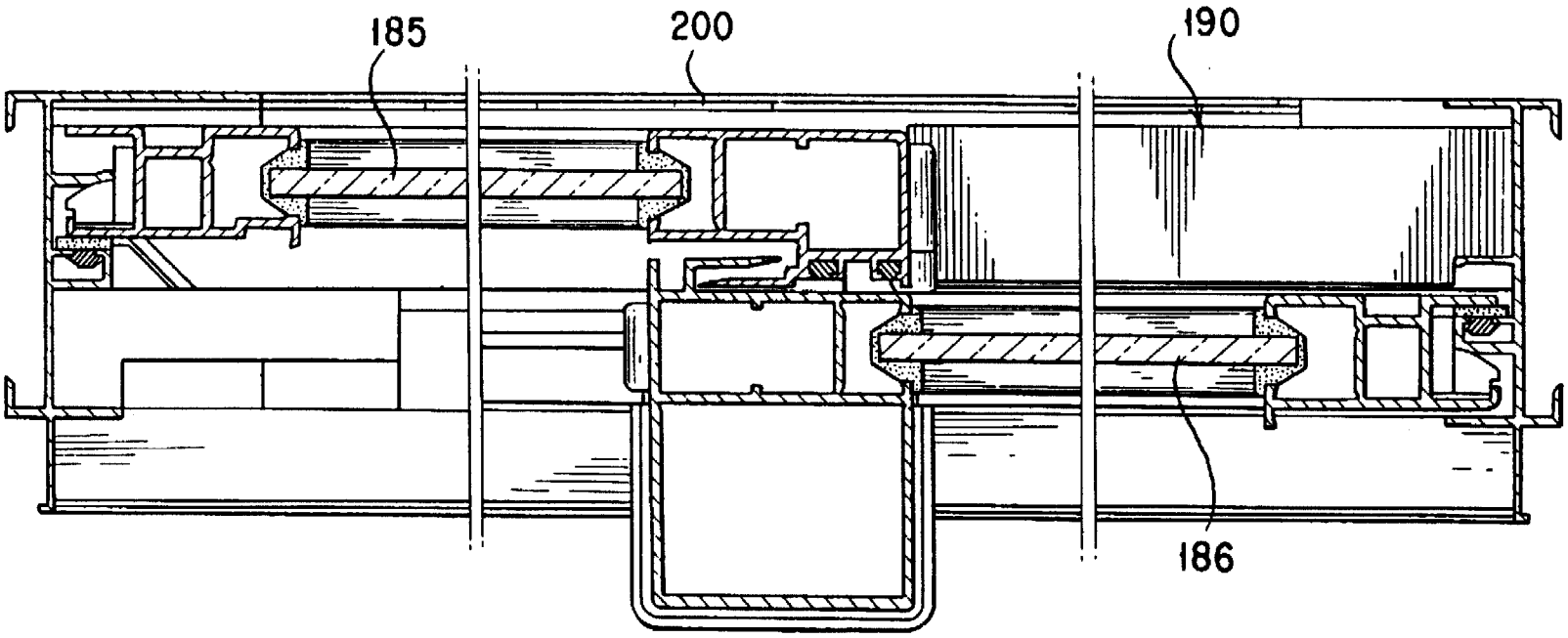
FIG. 22 is a horizontal sectional view of the window structure of FIG. 19.

As shown in FIGS. 21 and 22, according to this embodiment of the present invention, the indoor side sash 186 is mounted on the rail 187. The outdoor side sash 185 is mounted on the rail 199 on one of the laterally left and right sides (the left side according to FIG. 22) of the window frame. In this state, since the outdoor side sash 185 occupies substantially half the longitudinal length of the lower frame member 182, a space above the rail 199 on the lateral one side opposite to that occupied by the outdoor side sash 185 is vacant. According to this embodiment of the present invention, an attachment 190 having an upper flat surface and having a longitudinal length substantially half the longitudinal length of the lower flame member 182 is mounted to this vacant space as shown in FIGS. 20 and 22. The attachment 190 is adjacent to the outdoor side sash 185, thereby fixing the outdoor side sash 185. Thus, an inside single sliding window structure is constituted. When the attachment 190 is mounted to the lower frame member 182, the upper flat surface of the attachment 190 is substantially at the same height level as an upper end of the rail 187 of the lower frame member 182. Thus, a wheelchair can easily go in or out at this portion of the window.

As shown in FIG. 20, the attachment 190 has a box-like configuration having an upper flat surface. The attachment 190 is mounted to the lower frame member 182 by fitting its indoor side bottom end portion to the lower frame member 182 below the rail 187, and fixing its fitting piece 201 formed at the bottom portion thereof to the side surface of the rail 199 by means of screws. A partition piece 200 is further fixed to the outdoor side side surface of the attachment 190 by means of screws.

According to the various embodiments of the present invention described above, the attachment is mounted to the lower frame member having a step-like configuration, thereby providing a substantially flat surface on the lower frame member. Therefore, a person can easily go in and out through this flatted portion of the window structure, and even by a wheelchair, also can go in and out easily and smoothly. Further, since the step-like configuration of the lower frame member proper is left as it is, rain water is prevented from blowing or invading into an inside room along the lower frame member. Furthermore, since the attachment is so provided as to cover only the outdoor side portion of the lower frame member and therefore has a smaller size, material required for the attachment is reduced, which contributes to lowering of cost.

What is claimed is:

1. A sliding window structure having a window frame comprising an upper frame member, a lower frame member and bilateral side vertical frame members assembled in substantially rectangular shape, and an indoor side sash and an outdoor side sash fitted to said window frame, said lower frame member comprising an indoor side portion to which said indoor side sash is mounted and an outdoor side portion to which said outdoor side sash is mounted and having a step-like configuration in which said indoor side portion has a height higher than a height of said outdoor side portion, wherein an attachment is mounted to said outdoor side portion of said lower frame so as to cover laterally at least part of said outdoor side portion, an upper end of said attachment being substantially at the same height level as an upper end of said indoor side portion of said lower frame member, and further wherein said sliding window structure constitutes an inside single sliding window structure in which said indoor side sash is mounted on a rail integrally formed on said indoor side portion of said lower frame member so as to be slidable in a width direction of the window frame, and said outdoor side sash is mounted and fixed to said outdoor side portion of said lower frame member on one of the laterally left and right sides of the window frame, wherein said attachment is provided with an upper flat surface and is mounted to said outdoor side portion of said lower frame member on the lateral one side opposite to that occupied by said outdoor side sash, said upper flat surface of said attachment being substantially at the same height level as an upper end of said rail of said lower frame member, and an upwardly opening recessed portion being defined between said attachment and said indoor side portion of said lower frame member, through which said indoor side sash is slidable.

2. A sliding window surface according claim 1 wherein said attachment is a member having an inner hollow portion defined by an upper transverse plate, a lower transverse plate, an indoor side vertical plate and an outdoor side vertical plate, an upper surface of said upper transverse plate is substantially at the same height level as an upper end of said rail of said lower frame member, and said indoor side vertical plate forms an outdoor side wall and a bottom of said upwardly opening recessed portion.

3. A sliding window structure according to claim 2, wherein drain ports are positioned on each of the outdoor side wall of said upwardly opening recessed portion, said lower transverse plate and said outdoor side vertical plate such that water coming in said upwardly opening recessed portion is drainable outward through said drain ports.

4. A sliding window structure according to claim 2, wherein said attachment has a support piece and an attachment piece each projecting downwardly from said lower transverse plate, said attachment being mounted on said outdoor side portion of said lower frame member with the support piece and the attachment piece, and drain ports are positioned on each of the bottom of said upwardly opening recessed portion, said support piece and said attachment piece such that water coming in said upwardly opening recessed portion is drainable outward without passing through said inner hollow portion of said attachment.

5. A sliding window structure according to claim 1, wherein said attachment is a member having an upper transverse plate, an indoor side vertical plate and an outdoor side vertical plate, and defining an inner hollow portion in cooperation with an upper surface of said lower frame member, an upper surface of said upper transverse plate being positioned substantially at the same height level as an upper end of said rail of said lower frame member, and said indoor side vertical plate forming an outdoor side wall and a bottom of said upwardly opening recessed portion.

6. A sliding window structure according to claim 1, wherein said lower frame member is a lower frame member of an existing inside single sliding window structure in which a rail is integrally formed at an indoor side portion and a frame element for mounting and fixing a sash therein is attached at an outdoor side portion, said attachment is formed with a rail having substantially the same configuration as that of said rail of said lower frame member and is mounted to said lower frame member so as to cover the outdoor side portion thereof from which said frame element is removed, an upper end of said rail of said attachment being substantially at the same height level as an upper end of said rail of said lower frame member, said indoor side sash is mounted on said rail of said lower frame member and said outdoor side sash is mounted on said rail of said attachment, thereby constituting a double sliding window structure.

7. A sliding window structure according to claim 1, wherein said lower frame member is a lower frame member of an existing double sliding window structure in which a first rail is integrally formed at an indoor side portion and a second rail is integrally formed at an outdoor side portion, an upper end of said first rail being at a level higher than an upper end of said second rail, said attachment is formed with a rail having substantially the same configuration as that of said first rail and is mounted on said second rail, an upper end of said rail of said attachment being substantially at the same height level as an upper end of said first rail of said lower frame member, said indoor side sash is mounted on said first rail of said lower frame member and said outdoor side sash is mounted on said rail of said attachment, thereby constituting a double sliding window structure.

8. A sliding window structure according to claim 1, wherein said lower frame member is a lower frame member of an existing outside single sliding window structure in which a mounting groove for mounting and fixing a sash therein is integrally formed at an indoor side portion and a rail is integrally formed at an outdoor side portion, said attachment is formed with a rail and is mounted on said rail of said lower frame member, an upper end of said rail of said attachment being substantially at the same height level as an upper end of said mounting groove of said lower frame member, said indoor side sash is mounted and fixed in said mounting groove of said lower frame member on one of the laterally left and right sides of the window frame and said outdoor side sash is mounted on said rail of said attachment, thereby constituting an outside single sliding window structure.

9. A sliding window structure according to claim 8, wherein a cover is further attached to said mounting groove of said lower frame member on the lateral one side opposite to that occupied by said indoor side sash, an upper surface of said cover being substantially at the same height level as an upper end of said rail of said attachment.

10. A sliding window structure according to claim 1, wherein said lower frame member is a lower frame member of an existing inside single sliding window structure having a rail integrally formed at an indoor side portion thereof, a frame element formed with a mounting groove and having a longitudinal length substantially half the longitudinal length of said lower frame member is attached to an outdoor side portion of said lower frame member on one of the laterally left and right sides of the window frame, said indoor side sash is mounted on said rail and said outdoor side sash is mounted and fixed in said mounting groove, thereby constituting an inside sliding window structure, and said attachment has an upper flat surface and has a longitudinal length substantially half the longitudinal length of said lower frame member and is mounted to said outdoor side portion of said lower frame member on the lateral one side opposite to that occupied by said outdoor side sash, said upper flat surface of said attachment being substantially at the same height level as an upper end of said rail of said lower frame member.

11. A sliding window structure according to claim 1, wherein said lower frame member is a lower frame member of an existing double sliding window structure in which a first rail is integrally formed at an indoor side portion and a second rail is integrally formed at an outdoor side portion, an upper end of said first rail being at a level higher than an upper end of said second rail, said indoor side sash is mounted on said first rail, said outdoor side sash is mounted on said second rail on one of the laterally left and right sides of the window frame, said attachment has an upper flat surface and has a longitudinal length substantially half the longitudinal length of said lower frame member and is mounted on said second rail on the lateral one side of the window frame opposite to that occupied by said outdoor side sash so as to be adjacent to said outdoor side sash and thereby fix said outdoor side sash, thereby constituting an inside single sliding window structure, said upper flat surface of said attachment being substantially at the same height level as an upper end of said first rail of said lower frame member.

* * * * *